US006899084B2

(12) United States Patent
Miyashita

(10) Patent No.: US 6,899,084 B2
(45) Date of Patent: May 31, 2005

(54) FUEL SUPPLY SYSTEM FOR INTERNAL COMBUSTION ENGINE

(75) Inventor: Shigeki Miyashita, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/759,178

(22) Filed: Jan. 20, 2004

(65) Prior Publication Data

US 2004/0154594 A1 Aug. 12, 2004

(30) Foreign Application Priority Data

Feb. 6, 2003 (JP) ..... 2003-029382

(51) Int. Cl.[7] ..... F02M 37/04
(52) U.S. Cl. ..... 123/446; 123/458; 123/506
(58) Field of Search ..... 123/446–447, 123/458, 496, 506; 417/286, 289, 297, 427

(56) References Cited

U.S. PATENT DOCUMENTS 4,777,921 A * 10/1988 Miyaki et al. ..... 123/456
5,058,553 A * 10/1991 Kondo et al. ..... 123/456
5,094,216 A * 3/1992 Miyaki et al. ..... 123/506
5,277,156 A * 1/1994 Osuka et al. ..... 123/198 DB
6,095,118 A * 8/2000 Klinger et al. ..... 123/446
6,655,362 B2 * 12/2003 Rembold et al. ..... 123/506

FOREIGN PATENT DOCUMENTS

| | | |
|---|---|---|
| JP | A 03-9067 | 1/1991 |
| JP | A 03-74564 | 3/1991 |
| JP | A 05-157013 | 6/1993 |
| JP | A 10-259769 | 9/1998 |
| JP | A 11-44276 | 2/1999 |

* cited by examiner

*Primary Examiner*—Thomas Moulis
(74) *Attorney, Agent, or Firm*—Oliff & Berridge, PLC

(57) ABSTRACT

In a fuel supply system for an internal combustion engine, there is provided a technology capable of keeping the pressure of fuel constant. Fuel pumps are provided in which the pressure of fuel to be discharged therefrom can be adjusted due to an increase and a decrease in the amount of the fuel discharged, and the discharge of fuel therefrom can be stopped. Fuel injection valves serve as a fuel pressure reducing device that reduces the fuel pressure raised by the fuel pumps. A fuel pressure adjusting section changes the number of operations of the fuel pumps and the amounts of fuel discharged from the fuel pumps in such a manner that an average value of the fuel pressure from after the fuel pressure has once been raised until the fuel pressure is again raised becomes substantially constant before and after the number of operations of said fuel pumps is changed.

18 Claims, 13 Drawing Sheets

FUEL SUPPLY SYSTEM FOR INTERNAL COMBUSTION ENGINE

BACKGROUND OF THE INVENTION

1. Field of the Invention

The present invention relates to a fuel supply system for an internal combustion engine.

2. Description of the Related Art

There have hitherto been known a variety of fuel supply systems for internal combustion engines, such as a technique of increasing and decreasing the number of operations of fuel pumps (i.e., the number of operating fuel pumps) according to the operating conditions of an internal combustion engine (for example, see a first patent document: Japanese patent application laid-open No. 03-9067 (pages 2, 3, and FIG. 2)), a technique of operating only one of fuel pumps at the time of engine starting (for example, see a second patent document: Japanese patent application laid-open No. 03-74564 (pages 3, 4, and FIGS. 3 and 4)), a technique of operating only one of fuel pumps at the time when the amount of fuel to be injected is limited (for example, see a third patent document: Japanese patent application laid-open No. 05-157013 (pages 2, 3, and FIG. 2)), a technique of using two fuel pumps for two common-rails, respectively (for example, see a fourth patent document: Japanese patent application laid-open No. 11-44276 (pages 3–6, and FIG. 1)), and a technique of using a plurality of fuel pumps with a different one thereof being operated every time an engine is started (for example, see a fifth patent document: Japanese patent application laid-open No. 10-259769 (pages 2–5, and FIG. 2)).

However, in cases where an internal combustion engine is equipped with a plurality of fuel pumps, the pressure of fuel supplied by these fuel pumps is caused to vary when the number of operations of the fuel pumps is changed. In addition, parts of fuel discharged from the respective fuel pumps might interfere with one another, so it would become difficult to suppress pulsations of the fuel pressure. If the fuel pressure is varied in this manner, it becomes difficult to perform stable fuel injection.

SUMMARY OF THE INVENTION

Accordingly, the present invention has been made in view of the above-mentioned problems, and has for its object to provide a technique capable of keeping the fuel pressure constant in a fuel supply system for an internal combustion engine.

In order to achieve the above object, according to a first aspect of the present invention, there is provided a fuel supply system for an internal combustion engine comprising: a plurality of fuel discharge devices in which the pressure of fuel to be discharged therefrom can be adjusted due to an increase and a decrease in the amount of the fuel discharged when said fuel discharge devices are in operation, and the discharge of fuel therefrom can also be stopped; a fuel pressure reducing device that reduces the fuel pressure raised by the fuel discharge devices; and a fuel pressure adjusting section that changes the number of operations of the fuel discharge devices and the amounts of fuel discharged from the fuel discharge devices in such a manner that an average value of the fuel pressure from after the fuel pressure has once been raised until the fuel pressure is again raised becomes substantially constant before and after the number of operations of said fuel discharge devices is changed.

A major feature of the present invention resides in that when the number of operations of the fuel discharge devices (i.e., the number of operating fuel discharge devices) is changed by means of the fuel pressure adjusting section, the amount of fuel discharged from each of the operating fuel discharge devices is changed in such a manner that the average fuel pressure after the fuel pressure has once been raised until it is again raised is held constant.

In the fuel supply system for an internal combustion engine as constructed in this manner, the fuel pressure will be reduced by the fuel pressure reducing device by the time the fuel is pressurized again after the fuel has been pressurized. Here, in order to make constant the average value of the fuel pressure after the fuel pressure has once been raised until it is again raised, the amount of fuel discharged from each of the fuel discharge devices is increased in accordance with the increasing pressure drop due to the fuel pressure reducing device, whereas the amount of fuel discharged from each of the fuel discharge devices is decreased in accordance with the decreasing pressure drop due to the fuel pressure reducing device. As a result, it is possible to obtain, before fuel discharge, the amount of fuel to be discharged which is required to make constant the average fuel pressure after the fuel has once been pressurized by a discharge of fuel until the fuel is again pressurized. Then, by changing the amount of fuel discharged from each of the fuel discharge devices based on the amount of discharged fuel thus obtained, it becomes possible to keep the average value of the fuel pressure constant.

Preferably, the fuel pressure reducing device comprises a fuel injection valve for injecting the fuel; and the fuel pressure adjusting section determines the amount of fuel discharged from the fuel discharge devices based on the fuel pressure before the discharge of fuel by the fuel discharge devices, the number of operations of the fuel discharge devices, and the number of fuel injections by the fuel injection valve during the time from after the fuel pressure has once been raised until the fuel pressure is again raised.

In the fuel supply system of the internal combustion engine as constructed in this manner, the fuel pressure before the discharge of fuel by each fuel discharge device can be estimated from the current operating history or the like. When fuel is discharged from each fuel discharge device, the fuel pressure is raised or increased, that is, the rate of increase of the fuel pressure has a correlation with the amount of fuel discharged. In addition, when fuel is injected from the fuel injection valve, the fuel pressure reduces, that is, the reduction rate of the fuel pressure has a correlation with the number of fuel injections. Accordingly, it becomes possible to calculate the reduction rate of the fuel pressure before and after fuel injection by the fuel injection valve. Further, the number of fuel injections after the fuel has once been pressurized until the fuel is again pressurized has a correlation with the number of operations of the fuel discharge devices. From the above correlation, it becomes possible to obtain an amount of fuel to be discharged which is required to make constant the average fuel pressure after the fuel has once been pressurized until the fuel is again pressurized.

Preferably, when the number of operations of the fuel discharge devices is increased, the fuel pressure adjusting section starts the discharge of fuel from at least one of stopped fuel discharge devices after the amount of fuel discharged from each of operating fuel discharge devices is decreased.

If the amount of fuel discharged from each fuel discharge device is not decreased when the number of operations of the fuel discharge devices is increased, the increase in the fuel pressure due to the increase in the number of operations of the fuel discharge devices exceeds the reduction in the fuel pressure due to the fuel injection of the fuel injection valve, thus resulting in an increase in the average fuel pressure. In contrast to this, if the number of operations of the fuel discharge devices is increased after the amount of fuel discharged from each of the fuel discharge devices has been decreased, it becomes possible to keep the average fuel pressure constant.

Preferably, when the number of operations of the fuel discharge devices is decreased, the fuel pressure adjusting section stops the discharge of fuel from at least one of the operating fuel discharge devices after the amount of fuel discharged from each of the other operating fuel discharge devices is increased.

If the amount of fuel discharged from each fuel discharge device is not increased when the number of operations of the fuel discharge devices is decreased, the reduction in the fuel pressure due to the fuel injection of the fuel injection valve cannot be supplemented, thus resulting in reduction in the average fuel pressure. In contrast to this, if the discharge of fuel from those of the fuel discharge devices which are to be stopped is inhibited after the amount of fuel discharged from each of the fuel discharge devices has been increased, it becomes possible to keep the average fuel pressure constant.

Preferably, when the number of operations of the fuel discharge devices is increased or decreased, the fuel pressure adjusting section gradually changes the amount of fuel discharged from each of the fuel discharge devices.

Accordingly, a rapid variation in the fuel pressure can be suppressed.

Preferably, the fuel supply system for an internal combustion engine further comprises a fuel discharge amount feedback control section that controls the amount of fuel discharged from each of the fuel discharge devices, wherein when the number of operations of the fuel discharge devices is increased, the fuel discharge amount feedback control section applies an amount of fuel to be discharged, which is determined based on a feedback control value before the increase in the number of operations of the fuel discharge devices, only to those of the fuel discharge devices which have been operating before the increase in the number of operations of the fuel discharge devices.

The feedback control value is the value of a control parameter for controlling the amount of fuel discharged from each of the fuel discharge devices to a desired value in a feedback manner, and this value is calculated from the amount of fuel discharged from each of the operating fuel discharge devices. However, there are individual differences in the fuel discharge devices, so the feedback control value varies for each fuel discharge device. Accordingly, there is a fear that if the same feedback control value as that for the fuel discharge devices already operated is applied to the fuel discharge devices freshly operated when the number of operations of the fuel discharge devices is increased, the amount of fuel discharged from each freshly operated fuel discharge device might not become a desired amount, thus resulting in variation in the fuel pressure. In contrast to this, by applying the feedback control value only to those of the fuel discharge devices which have been operating before the increase in the number of operations of the fuel discharge devices, it is possible to suppress the variation in the fuel pressure due to the individual differences in the fuel discharge devices.

In addition, in order to achieve the above object, according to a second aspect of the present invention, there is provided a fuel supply system for an internal combustion engine comprising: a plurality of fuel discharge devices in which the pressure of fuel to be discharged therefrom can be adjusted due to an increase and a decrease in the amount of the fuel discharged when the fuel discharge devices are in operation, and the discharge of fuel therefrom can also be stopped; a fuel pressure reducing device that reduces the fuel pressure raised by the fuel discharge devices; a fuel pressure detector that detects the pressure of fuel discharged from the fuel discharge devices; and a fuel discharge amount adjusting section that changes the amount of fuel discharged from each of the plurality of fuel discharge devices in such a manner that an average value of the fuel pressure detected by the fuel pressure detector during the time from after the fuel has once been pressurized by one of the fuel discharge devices until the fuel is again pressurized by another one of the fuel discharge devices becomes substantially constant.

In this case, a major feature of the present invention resides in that an average fuel pressure during the time from after the fuel has once been pressurized by one of the fuel discharge devices until the fuel is again pressurized by another one of the fuel discharge devices is obtained, and the amount of fuel discharged from each of the fuel discharge devices is changed so as to make the average fuel pressure thus obtained substantially constant, whereby variation in the average fuel pressure can be suppressed.

In the fuel supply system for an internal combustion engine as constructed in this manner, the fuel pressure is raised each time fuel is discharged by any one of the fuel discharge devices, and the fuel pressure is reduced by the fuel pressure reducing device. Then, the fuel pressure is raised again when fuel is discharged by another one of the fuel discharge devices. By detecting the fuel pressure between these fuel discharges, an average value of the fuel pressure is obtained, and the variation of the fuel pressure can be suppressed by changing the amount of fuel discharged from each of the fuel discharge devices so as to make the average fuel pressure thus obtained substantially constant.

Moreover, in order to achieve the above object, according to a third aspect of the present invention, there is provided a fuel supply system for an internal combustion engine comprising: a plurality of fuel discharge devices that discharge fuel; a plurality of fuel injection devices that inject the fuel pressurized by the fuel discharge devices; a fuel supply pipe having one end thereof branched to be connected with the plurality of fuel discharge devices, and the other end thereof provided with one outlet; and fuel delivery pipes branching from the one outlet of the fuel supply pipe so as to be connected with the plurality of fuel injection devices.

In this case, a major feature of the present invention resides in suppressing the pulsation of the fuel pressure in the fuel injection devices by once merging parts of fuel discharged from the plurality of fuel discharge devices at the fuel supply pipe.

In the fuel supply system for an internal combustion engine as constructed in this manner, the parts of fuel from the respective fuel discharge devices are once merged and then delivered to the plurality of fuel injection devices, whereby fuel can be supplied from one location to the plurality of fuel injection devices through the fuel delivery pipes. As a result, even when fuel is discharged by the plurality of fuel discharge devices, the directions of movement of the fuel in the fuel delivery pipes are united or made uniform, as a result of which pulsations of the fuel pressure can be suppressed.

Preferably, the plurality of fuel discharge devices successively discharge fuel into the fuel supply pipe at a constant interval between the discharge of fuel by one of the fuel discharge devices and the discharge of fuel by another one of the fuel discharge devices. Accordingly, fuel is discharged from the respective fuel discharge devices at timings at which resultant pulsations of the fuel in the fuel supply pipe can be counteracted with one another.

Further, in order to achieve the above object, according to a fourth aspect of the present invention, there is provided a fuel supply system for an internal combustion engine comprising: a low pressure fuel pump that discharges fuel at a low pressure; and a plurality of high pressure fuel pumps that further raise the pressure of fuel discharged from the low pressure fuel pump; wherein at least one of the high pressure fuel pumps serves, when stopped, as a fuel passable pump that can pass therethrough the fuel discharged from the low pressure fuel pump, and when the internal combustion engine is started, at least one of the high pressure fuel pumps is stopped in its operation to serve as a fuel passable pump, and at the same time at least another one of the high pressure fuel pumps is driven to operate.

In this case, a major feature of the present invention resides in that by stopping at least one of the high pressure fuel pumps at the time of engine starting, fuel can be supplied by the low pressure fuel pump so that reduction in the fuel pressure can be suppressed while making it possible to raise promptly the fuel pressure at the time of the engine starting.

In cases where a large amount of fuel are needed to be injected at cold starting, when the amounts of fuel to be injected exceed the amount of fuel discharged from each of the high pressure fuel pumps, the fuel pressure is reduced, thus making it impossible to perform further fuel injection. In contrast to this, using at least one of the high pressure fuel pumps acting as a fuel passable pump enables the low pressure fuel pump to perform fuel supply, whereby a larger amount of fuel can be supplied as compared with the case where fuel is supplied by means of normally acting high pressure fuel pumps alone. In this case, however, it takes a rather long time from the actuation of any of the high pressure fuel pumps until the fuel pressure reaches a desired pressure. Accordingly, by operating at least one of the high pressure fuel pumps upon starting of the engine, it is possible to shorten the time required to pressurize the fuel while suppressing reduction in the fuel pressure.

Preferably, the at least one high pressure pump capable of serving as a fuel passable pump is started to operate when the rotational speed of the engine has increased up to a prescribed speed at the time of engine starting, i.e., when the engine has come into an idle operating state. As a result, the fuel pressure discharged from the low pressure fuel pump begins to be raised by the at least one high pressure pump thus operated.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

<First Embodiment>

Hereinafter, preferred embodiments of the present invention will be described in detail while referring to the accompanying drawings. Here, reference will be made to the case where a fuel supply system for an internal combustion engine according to the present invention is applied to a gasoline engine for driving a vehicle.

Figure 1:
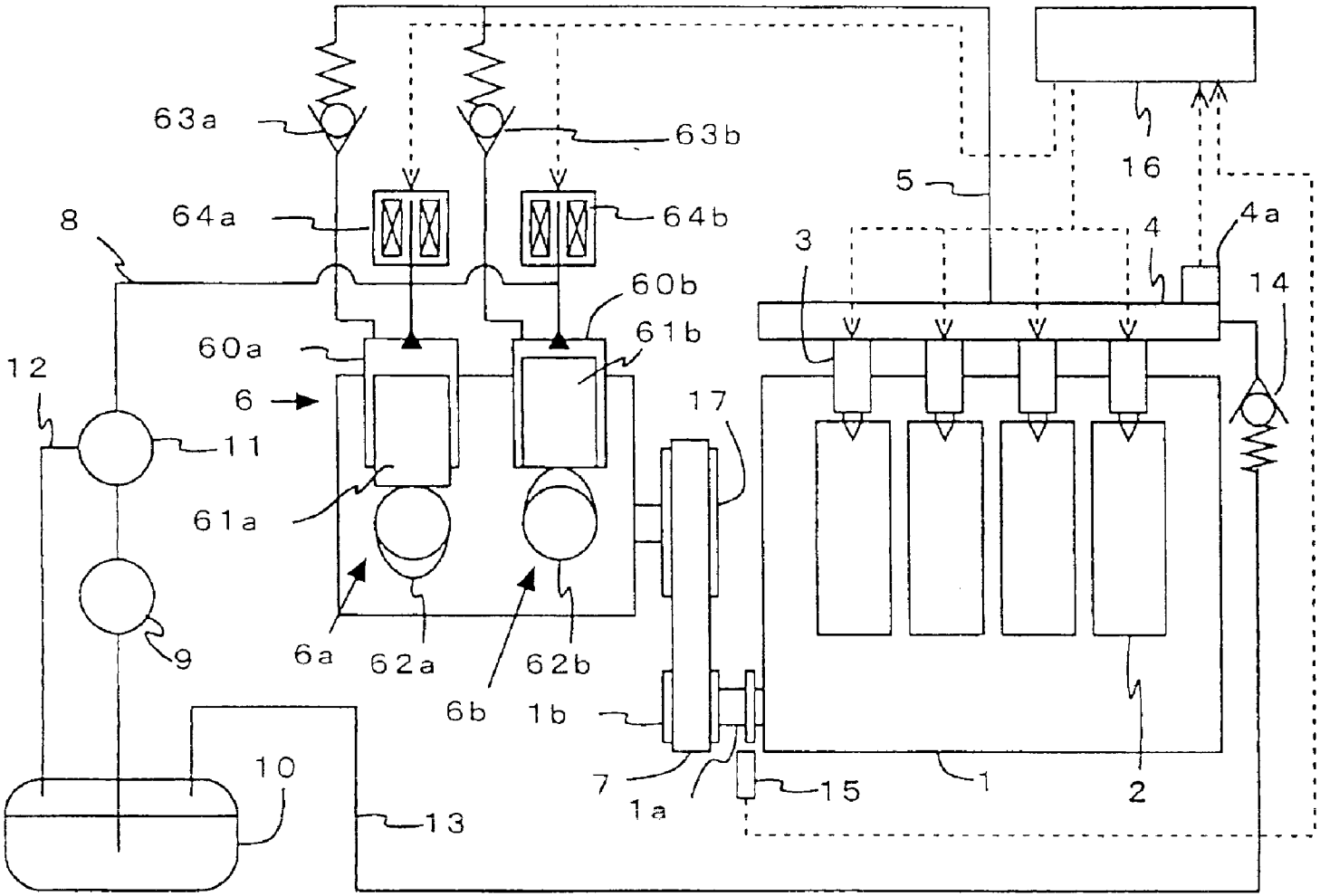
FIG. 1 is a view showing the schematic construction of an internal combustion engine with a fuel supply system applied thereto according to a first embodiment of the present invention.
Figure 12:
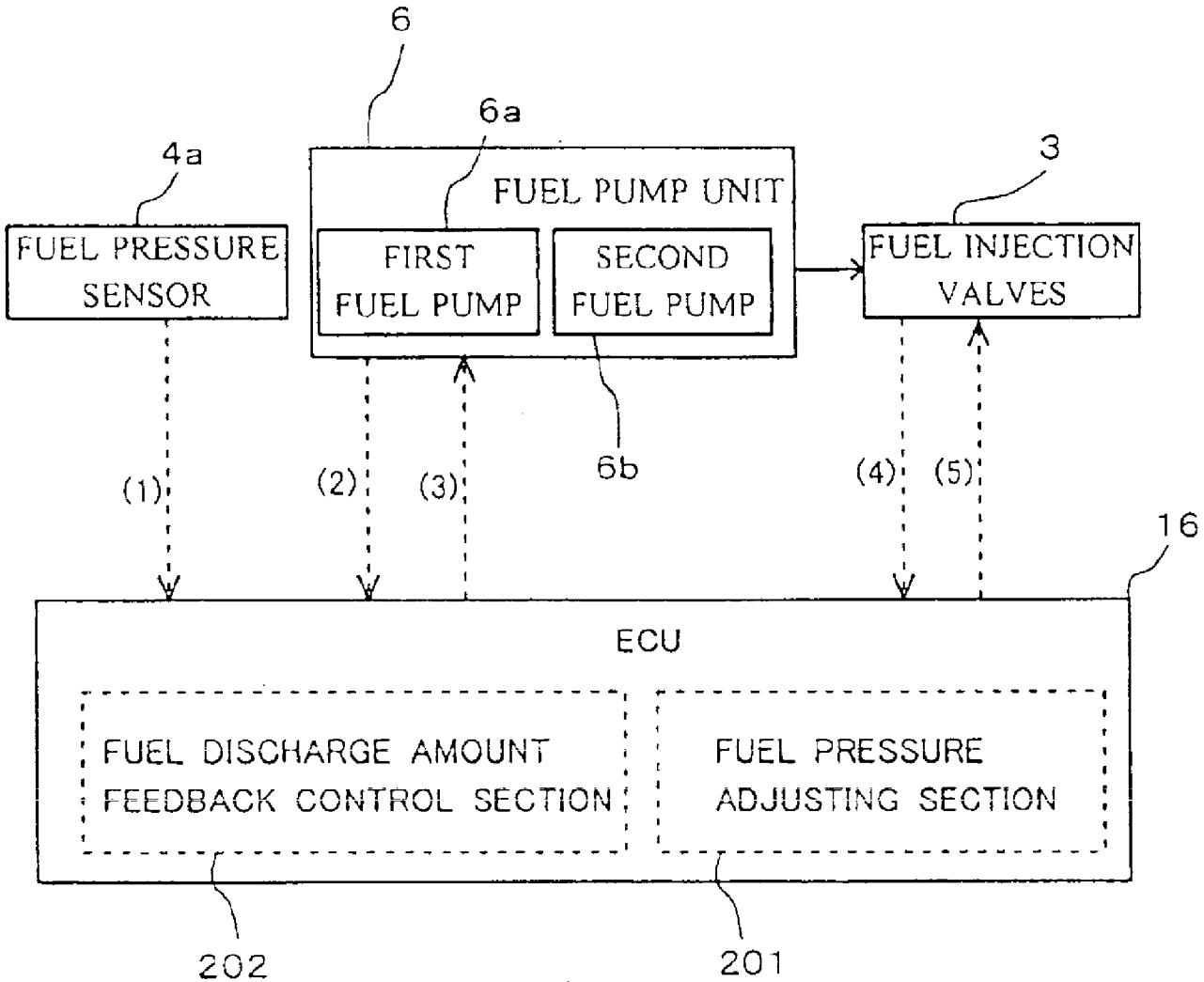
FIG. 12 is a view schematically showing the flow of control signals in the fuel supply system applied to the internal combustion engine according to the first embodiment of present invention.

FIG. 1 is a view that shows the schematic construction of an internal combustion engine 1 with a fuel supply system applied thereto according to a first embodiment of the present invention. In addition, FIG. 12 is a view that schematically shows the flow of control signals in the fuel supply system applied to the internal combustion engine 1.

The internal combustion engine 1 (hereinafter also referred to simply as an engine) as illustrated in FIG. 1 is a four-cycle gasoline engine having four cylinders 2.

The engine 1 is provided with four fuel injection valves 3, one for each cylinder 2, for directly injecting fuel into a combustion chamber of each cylinder 2. The fuel injection valves 3 are respectively connected with a delivery pipe 4 that serves to accumulate the fuel therein to a prescribed pressure. Mounted on this delivery pipe 4 is a fuel pressure sensor 4*a* for outputting a signal corresponding to the fuel pressure in the delivery pipe 4.

The delivery pipe 4 is in fluid communication with a fuel pump unit 6 through a fuel feed pipe 5. The fuel pump unit 6 is driven to operate by a driving source in the form of the rotational torque of an output shaft or crankshaft 1*a* of the engine 1. A pump pulley 17 mounted on an input shaft of the fuel pump unit 6 is connected with a crankshaft pulley 1*b* mounted on the crankshaft 1*a* through a belt 7.

The fuel pump unit 6 comprises a first fuel pump 6*a* and a second fuel pump 6*b*. The first fuel pump 6*a* is provided with a cylinder 60*a*, a piston 61*a* and a cam 62*a*, whereas the second fuel pump 6*b*is provided with a cylinder 60*b*, a piston 61*b*and a cam 62*b*. The piston 61*a*, 61*b*are driven to reciprocate by means of cams 62*a*, 62*b*, respectively, that are caused to rotate in accordance with the rotation of the pump pulley 17. These cams 62*a*, 62*b*are arranged in such a manner that the directions of their tops mutually shift 180 degrees from each other with respect to the rotational angle of the pump pulley 17.

The fuel feed pipe 5 connected at one end thereof with the delivery pipe 4 is branched at the other end thereof to be connected with the outlet sides of the cylinders 60*a*, 60*b* with check valves 63*a*, 63*b* being interposed between the branched portions of the delivery pipe 4 and the cylinders 60*a*, 60*b*, respectively, so as to pass the fuel only in a direction from the fuel pump unit 6 to the delivery pipe 4.

In addition, electromagnetic valves 64*a*, 64*b*, which are adapted to be electrically driven to open and close, are provided at the inlet sides of the cylinders 60*a*, 60*b*, respectively. A low pressure pipe 8 is branched at one end thereof to be connected with the electromagnetic valves 64*a*, 64*b*, and is connected at the other end thereof with a fuel tank 10 through a low pressure fuel pump 9. This low pressure fuel pump 9 is a pump that is operated by electric power supplied thereto. Connected with the low pressure pipe 8 at a location between the low pressure fuel pump 9 and the electromagnetic valves 64*a*, 64*b*is a low pressure regulator 11 which is opened to exhaust the fuel in the low pressure pipe 8 to the fuel tank 10 when the fuel pressure in the low pressure pipe 8 is increased to a desired pressure, so that the fuel pressure in the low pressure pipe 8 is always kept constant. A low pressure return pipe 12 is connected at one end thereof with the low pressure regulator 11 and is at the other end thereof with the fuel tank 10 so as to pass the fuel exhausted from the low pressure regulator 11 to the fuel tank 10.

On the other hand, the delivery pipe 4 and the fuel tank 10 are connected with each other through a high pressure return pipe 13. A relief valve 14 is mounted on the high pressure return pipe 13 at a location between the delivery pipe 4 and the fuel tank 10 in a manner such that it is opened to pass the fuel only in a direction from the delivery pipe 4 to the fuel tank 10 when the pressure in the delivery pipe 4 is increased to a desired or prescribed pressure.

In the fuel injection system as constructed in this manner, when electric power is supplied to energize the low pressure fuel pump 9, fuel is drawn up from the fuel tank 10 to raise the fuel pressure in the low pressure pipe 8. Here, when the fuel pressure in the low pressure pipe 8 is raised to the desired pressure, the low pressure regulator 11 is opened so that the fuel is returned to the fuel tank 10 through the low pressure return pipe 12, thus keeping the fuel pressure in the low pressure pipe 8 constant.

Moreover, when the rotational torque of the crankshaft 1*a* is transmitted to the input shaft of the fuel pump unit 6, the cam 62*a*, 62*b* are thereby driven to rotate, thus causing the piston 61*a*, 61*b* to reciprocate.

When the electromagnetic valve 64*a*or 64*b*is in its open state, the fuel in the low pressure pipe 8 is introduced in the corresponding cylinder 60*a* or 60*b*. On the other hand, when the electromagnetic valve 64*a* or 64*b*is closed and when the piston 61*a*or 61*b*is moved upward by means of the corresponding cam 62*a*or 62*b*, the fuel in the cylinder 60*a* or 60*b* is compressed by the piston 61*a* or 61*b* to be discharged therefrom to the fuel feed pipe 5. The amount of fuel discharged at this time is adjusted by the closure time of the electromagnetic valve 64*a* or 64*b*. That is, when the electromagnetic valve 64*a* or 64*b* is opened during the compression of the fuel due to the piston 61*a* or 61*b*, the compressed fuel flows back to the low pressure pipe 8. As a result, the fuel pressure in the low pressure pipe 8 is raised or increased by the backflow of the fuel, but the low pressure regulator 11 is opened so that the fuel is returned to the fuel tank 10. On the other hand, after the opening of the electromagnetic valve 64*a* or 64*b*, the backflow of the fuel is suppressed by the corresponding check valve 63*a* or 63*b*, so the fuel pressure at the downstream side of the check valve 63*a* or 63*b* is thereby prevented from being reduced. Thus, the amount of fuel discharged in the engine 1 can be properly adjusted.

Further, since the tops of the cams 62*a*, 62*b* are arranged to differ or shift 180 degrees from each other with respect to the rotational angle of the pump pulley 17, fuel is alternately discharged from the cylinders 60*a*, 60*b*.

The fuel discharged from the fuel pump unit 6 is supplied through the fuel feed pipe 5 to the delivery pipe 4, where it is accumulated to a prescribed pressure, and it is then distributed to the fuel injection valves 3, respectively. Thereafter, when a drive current is applied to the fuel injection valves 3, the fuel injection valves 3 are operated to open so that fuel is injected from the fuel injection valves 3 into the corresponding cylinders 2, respectively.

Furthermore, a crank position sensor 15 is installed on the engine 1 at an appropriate location near the crankshaft 1*a* for detecting the rotational position of the crankshaft 1*a* to generate a corresponding electric signal.

An electronic control unit (ECU) 16 for controlling the engine 1 is provided in conjunction with the engine 1 as constructed in the above-described manner. This ECU 16 serves to control the operating condition of the engine 1 in accordance with the operating state of the vehicle and the driver's requirements.

A variety of kinds of sensors are electrically connected to the ECU 16 through electric wiring.

Also, the fuel injection valve 3, the electromagnetic valves 64*a*, 64*b* and the like are connected to the ECU 16 through electric wiring so that the ECU 16 can control the above-mentioned respective parts. The connections of these parts to the ECU 16 through the electric wiring has been represented by dotted lines in FIG. 1.

However, in the internal combustion engine 1, the number of operations of the pumps (i.e., operating pumps) in the fuel pump unit 6 can be changed in accordance with the engine operating condition. For example, the consumption of fuel is small under low load conditions, and hence even if either one of the first fuel pump 6*a* or the second fuel pump 6*b* is stopped, it is possible to ensure the required amount of fuel to be supplied. By stopping either one of the first and second fuel pumps 6*a*, 6*b*, it is possible to reduce the work of the corresponding piston 61*a* or 61*b* to compress the fuel or the electric power needed to drive the electromagnetic valve 64*a* or 64*b*, whereby fuel consumption can be improved.

In addition, at the time of the engine being rotating at high speed, the frequency of fuel discharges by the fuel pumps becomes high due to the high speed rotations thereof, and hence variation in the fuel pressure is reduced. Accordingly, the fluctuation of the output power between engine cycles due to the fuel pressure variation at the high speed rotation of the engine is also reduced. As a result, by stopping either one of the first and second fuel pumps 6*a*, 6*b*, the fuel compressing work of the corresponding piston 61*a* or 61*b* or the electric power needed to drive the electromagnetic valve 64*a* or 64*b* can be decreased, thus making it possible to improve the fuel consumption.

Here, note that in order to suppress the average variation of the fuel pressure in the delivery pipe 4 before and after the number of operating fuel pumps is increased or decreased, the amount of fuel discharged from each fuel pump has been changed. That is, when the number of operating pumps is increased from one to two, the amount of fuel discharged per pump is reduced by half, whereas when the number of operating pumps is decreased from two to one, the amount of fuel discharged per pump is doubled.

However, when the number of operating fuel pumps is changed, the average fuel pressure will be increased or decreased depending upon the timing at which the amount of fuel discharged from the first fuel pump 6*a* or the second fuel pump 6*b* is changed. As a result, there is a fear that an excess or shortage of the amount of fuel supply might occur. If an excessive fuel supply occurs, the fuel compression work of the piston 61*a* or 61*b* or the electric power needed to drive the electromagnetic valve 64*a* or 64*b* increases to induce a deterioration in the fuel consumption, whereas when a shortage of the amount of discharged fuel occurs, reduction in the engine output power is induced.

Accordingly, in this embodiment, the amount of fuel to be discharged is determined in such a manner that the average fuel pressure in the delivery pipe 4 after the fuel have once been pressurized until the fuel is again pressurized becomes equal or constant before and after the number of operating pumps is changed.

Figure 2:
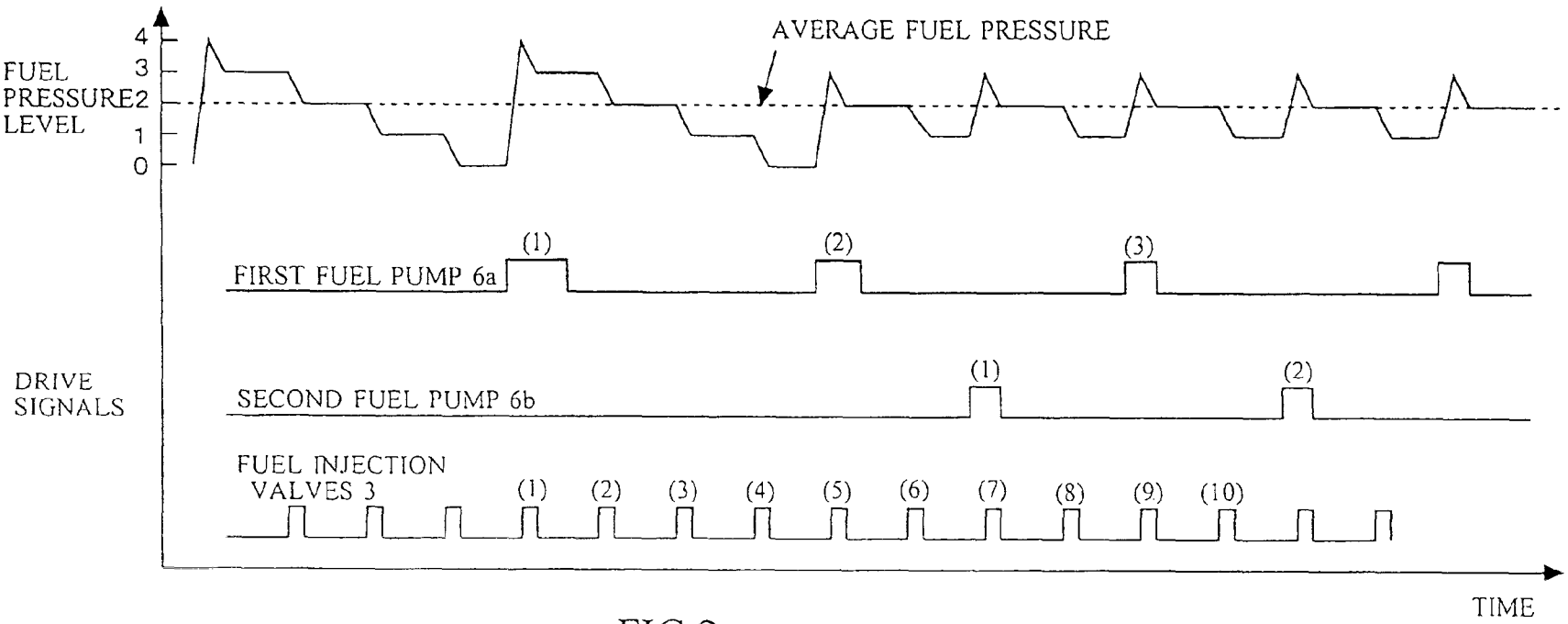
FIG. 2 is a timing chart showing the time course of a fuel pressure level, drive signals for electromagnetic valves, and a drive signal for fuel injection valves when the number of operating fuel pumps is increased after the amount of fuel discharged from a currently operating fuel pump has been decreased, according to the first embodiment of the present invention.

Here, FIG. 2 is a timing chart that shows the time course of the fuel pressure level, drive signals for the electromagnetic valves 64*a*, 64*b*, and a drive signal for the fuel injection valves 3 when the number of operating pumps is increased after the amount of fuel discharged from a currently operating fuel pump has been decreased.

The fuel pressure level in FIG. 2 does not represent an actual fuel pressure but instead a target value of the fuel pressure at sequential points in time. That is, note that the fuel pressure level means the possible number of injections to be made by the fuel injection valves 3, wherein no fuel injection can be made in the case of the fuel pressure level being 0, and one fuel injection can be made in the case of the fuel pressure level being 1.

In the drive signal for the electromagnetic valve 64*a* or 64*b*, the electromagnetic valve 64*a* or 64*b* is closed when the corresponding drive signal has an upward convex, so that the fuel in the corresponding cylinder 60*a* or 60*b* can be discharged to the delivery pipe 4. The amount of fuel thus discharged increases in accordance with the increasing valve closure time of the electromagnetic valve 64*a* or 64*b*, so that the rate of increase of the fuel pressure in the delivery pipe 4 becomes large. That is, the rate of increase of the fuel pressure level becomes large.

In the drive signal for the fuel injection valves 3, one of the fuel injection valves 3 is opened to inject the fuel in the delivery pipe 4 into a corresponding cylinder 2 when the drive signal has an upward convex or a rectangular-shaped pulse.

In FIG. 2, at first, only the first fuel pump 6*a* discharges fuel (i.e., operating), but the second fuel pump 6*b* stops discharging fuel (i.e., stops its operation). Then, the fuel pressure in the delivery pipe 4 is raised by a first valve closing pulse (1) of the drive signal for the first fuel pump 6*a*, during which fuel is injected into one of the cylinders 2 from a corresponding one of the fuel injection valves 3 by means of a first rectangular-shaped valve driving pulse (1) of the drive signal for the fuel injection valves 3, so the fuel pressure in the delivery pipe 4 is reduced. Thereafter, the fuel pressure is reduced whenever the injection of fuel is performed by each of second through fourth valve driving pulses (2) through (4) of the drive signal for the fuel injection valves 3.

The length of the first valve closing pulse (1) of the drive signal (hereinafter referred to simply as the first valve closing signal pulse (1)) for the first fuel pump 6*a* is determined in such a manner that even if the fuel pressure in the delivery pipe 4 is reduced as a result of three fuel injections according to the first through third valve driving pulses (1) through (3) of the drive signal (hereinafter referred to simply as the first through third valve driving signal pulses) for the fuel injection valves 3, there still remains such a fuel pressure under which the injection of fuel according to a fourth valve driving signal pulse (4) for the fuel injection valves 3 can be made. More specifically, the length of the first valve closing signal pulse (1) for the first fuel pump 6*a* is determined so as to make the average fuel pressure equal to a fuel pressure level 2.

Then, the length of a subsequent second valve closing signal pulse (2) for the first fuel pump 6*a* is properly shortened while taking account of a pressure rise in the second fuel pump 6*b* that is to be operated thereafter. That is, if this is set equal to the valve closure time or length of the first valve closing signal pulse (1) for the first fuel pump 6*a*, the fuel pressure level is raised to 4, and even if two fuel injections are thereafter made according to a fifth valve driving signal pulse (5) and a sixth valve driving signal pulse (6) for the fuel injection valves 3, the fuel pressure level in the delivery pipe 4 is reduced to 2. When the fuel in the delivery pipe 4 is pressurized from this state by the second fuel pump 6*b*, even if the length of the first valve closing signal pulse (1) for the second fuel pump 6*b* is set equal to half the length of the second valve closing signal pulse (2) for the first fuel pump 6*a*, the fuel pressure level is raised up to 4. Further, even if fuel injections are thereafter made according to seventh and eighth valve driving signal pulses (7), (8) for the fuel injection valves 3, the fuel pressure level becomes 2. In this manner, the fuel pressure level always becomes higher than or equal to 2, thus resulting in an increased average fuel pressure level.

Accordingly, the length of the second valve closing signal pulse (2) for the first fuel pump 6*a* is determined in such a manner that the average fuel pressure from before the fuel injection according to the fifth valve driving signal pulse (5) for the fuel injection valves 3 until after the fuel injection according to the sixth valve driving signal pulse (6) for the fuel injection valves 3 becomes equal to the average fuel pressure from before the fuel injection according to the first valve driving signal pulse (1) for the fuel injection valves 3 until after the injection according to the fourth valve driving signal pulse (4) for the fuel injection valves 3, that is, the average fuel pressure level becomes 2.

Here, note that there are two fuel injections according to the fifth and sixth valve driving signal pulses (5), (6) for the fuel injection valves 3 during the time from the second valve closing signal pulse (2) for the first fuel pump 6*a* to the first valve closing signal pulse (1) for the second fuel pump 6*b*. That is, the fuel pressure level is reduced by 2. On the other hand, the fuel pressure level is 0 immediately before the second valve closing signal pulse (2) for the first fuel pump 6*a*. Accordingly, in order to make the average fuel pressure level become 2, it is necessary to raise the fuel pressure level up to 3 according to the second valve closing signal pulse (2) for the first fuel pump 6*a*. Therefore, the length of the second valve closing signal pulse (2) for the first fuel pump 6*a* is set to a length needed to raise the fuel pressure level from 0 to 3. Incidentally, the relation between the fuel pressure level and the length of each valve closing signal pulse for the first fuel pump 6*a* has been determined in advance by experiments or the like, mapped properly and stored in the ECU 16.

Similarly, the length of the first valve closing signal pulse (1) for the second fuel pump 6*b* is determined in such a manner that the average fuel pressure from before the fuel injection according to the seventh valve driving signal pulse (7) for the fuel injection valves 3 until after the injection according to the eighth valve driving signal pulse (8) for the fuel injection valves 3 becomes equal to the average fuel pressure from before the fuel injection according to the fifth valve driving signal pulse (5) for the fuel injection valves 3 until after the injection according to the sixth valve driving signal pulse (6) for the fuel injection valves 3.

Here, note that there are two fuel injections according to the seventh and eighth valve driving signal pulses (7), (8) for the fuel injection valves 3 during the time from the first valve closing signal pulse (1) for the second fuel pump 6*b* to a third valve closing signal pulse (3) for the first fuel pump 6*a*. That is, the fuel pressure level is reduced by 2. On the other hand, the fuel pressure level is 1 immediately before the first valve closing signal pulse (1) for the second fuel pump 6*b*. Accordingly, in order to make the average fuel pressure level become 2, it is necessary to raise the fuel pressure level up to 3 according to the first valve closing signal pulse (1) for the second fuel pump 6*b*. Therefore, the length of the first valve closing signal pulse (1) for the second fuel pump 6*b* is set to a length needed to raise the fuel pressure level from 1 to 3. Incidentally, the relation between the fuel pressure level and the length of each valve closing signal pulse for the second fuel pump 6*b* has been determined in advance by experiments or the like, mapped properly and stored in the ECU 16.

Thereafter, the above processes are repeatedly carried out so that the average fuel pressure can be kept constant.

Figure 3:
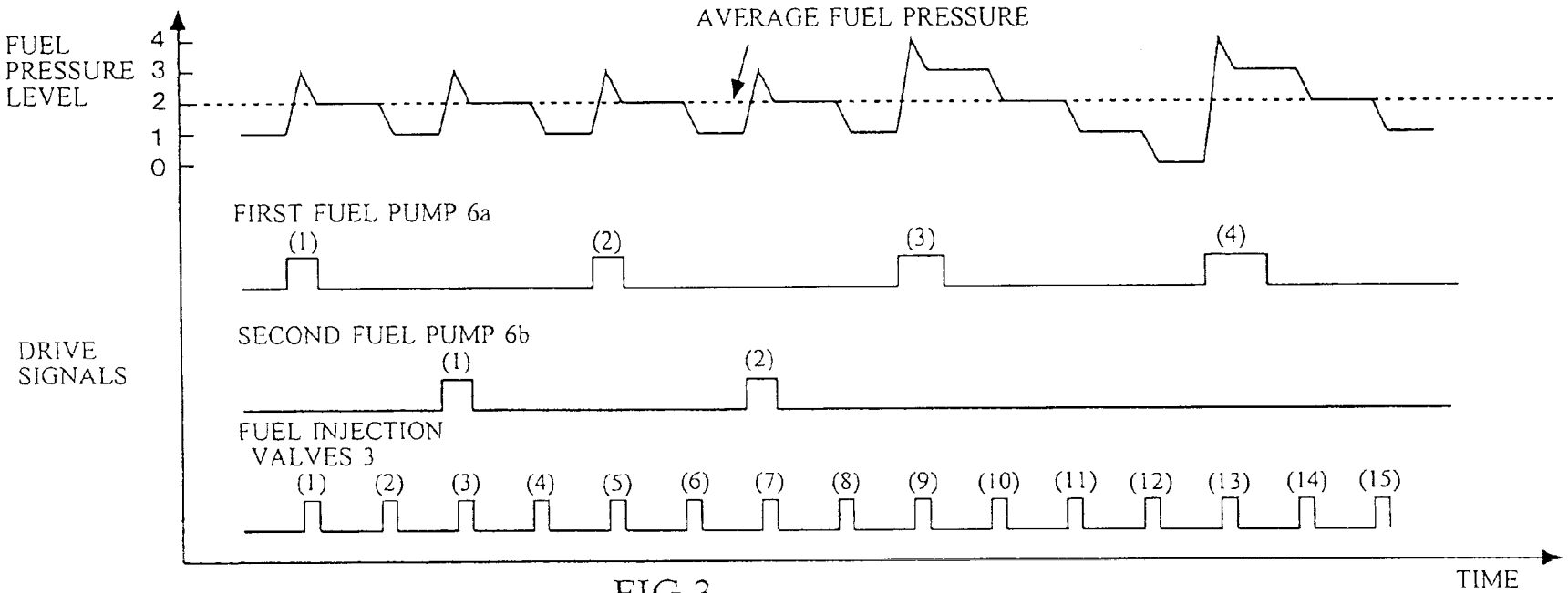
FIG. 3 is a timing chart showing the time course of a fuel pressure level, drive signals for electromagnetic valves, and a drive signal for fuel injection valves when the number of operating fuel pumps is decreased after the amount of fuel discharged from a currently operating fuel pump has been increased, according to the first embodiment of the present invention.

Next, FIG. 3 is a timing chart that shows the time course of the fuel pressure level, the drive signals for the electromagnetic valves 64*a*, 64*b*, and the drive signal for the fuel injection valves 3 when the number of operating pumps is decreased after the amount of fuel discharged from one currently operating fuel pump has been increased.

In FIG. 3, at first, the first fuel pump 6*a* and the second fuel pump 6*b* alternately discharge fuel from the corresponding cylinders 60*a*, 60*b*. First of all, the fuel pressure in the delivery pipe 4 is raised up to a fuel pressure level 3 according to the first valve closing signal pulse (1) for the first fuel pump 6*a*, during which fuel is injected into one of the cylinders 2 from a corresponding one of the fuel injection valves 3 by means of the first valve driving signal pulse (1) for the fuel injection valves 3, so the fuel pressure in the delivery pipe 4 is reduced to the fuel pressure level 2. Further, fuel injection is thereafter performed according to the second valve driving signal pulse (2) for the fuel injection valves 3, whereby the fuel pressure is reduced to the fuel pressure level 1.

The length of the first valve closing signal pulse (1) for the first fuel pump 6*a* is determined in such a manner that even if the fuel pressure in the delivery pipe 4 is reduced as a result of the fuel injection according to the first valve driving signal pulse (1) for the fuel injection valves 3, there still remains such a fuel pressure under which fuel injection according to the second valve driving signal pulse (2) for the fuel injection valves 3 can be made. More specifically, the length of the first valve closing signal pulse (1) for the first fuel pump 6*a* is determined so as to make the average fuel pressure equal to the fuel pressure level 2.

Similarly, the length of the first valve closing signal pulse (1) for the second fuel pump 6*b* is determined in such a manner that the average fuel pressure from before the fuel injection according to the third valve driving signal pulse (3) for the fuel injection valves 3 until after the fuel injection according to the fourth valve driving signal pulse (4) for the fuel injection valves 3 becomes equal to the average fuel pressure from before the fuel injection according to the first valve driving signal pulse (1) for the fuel injection valves 3 until after the injection according to the second valve driving signal pulse (2) for the fuel injection valves 3, that is, the average fuel pressure level becomes the fuel pressure level 2.

The length of the second valve closing signal pulse (2) for the first fuel pump 6*a* and the length of the second valve closing signal pulse (2) for the second fuel pump 6*b* are obtained in the same way.

Then, the length of a subsequent third valve closing signal pulse (3) for the first fuel pump 6*a* is properly extended while taking account of a pressure drop in the second fuel pump 6*b* that is to be stopped thereafter. That is, if this is set to a valve closure time similar to that for the first or second valve closing signal pulse (1) or (2) for the first fuel pump 6*a*, the fuel pressure level is raised to 3, but the fuel pressure level is reduced to 0 by fuel injection according to an eleventh valve driving signal pulse (11) for the fuel injection valves 3, which is to be performed after two fuel injections according to the ninth and tenth valve driving signal pulses (9), (10) for the fuel injection valves 3. As a result, it becomes impossible to perform fuel injection according to a twelfth valve driving signal pulse (12) for the fuel injection valves 3.

Accordingly, the length of the third valve closing signal pulse (3) for the first fuel pump 6*a* is determined in such a manner that the average fuel pressure from before the fuel injection according to the ninth valve driving signal pulse (9) for the fuel injection valves 3 until after the fuel injection according to the twelfth valve driving signal pulse (12) for the fuel injection valves 3 becomes equal to the average fuel pressure from before the fuel injection according to the seventh valve driving signal pulse (7) for the fuel injection valves 3 until after the injection according to the eighth valve driving signal pulse (8) for the fuel injection valves 3, that is, the average fuel pressure level becomes the fuel level 2.

Here, note that there are four fuel injections according to the ninth through twelfth valve driving signal pulses (9) through (12) for the fuel injection valves 3 during the time from the third valve closing signal pulse (3) for the first fuel pump 6*a* to a fourth valve closing signal pulse (1) for the first fuel pump 6*a*. That is, the fuel pressure level is reduced by 4. On the other hand, the fuel pressure level is 1 immediately before the third valve closing signal pulse (3) for the first fuel pump 6*a*. Accordingly, in order to make the average fuel pressure level become 2, it is necessary to raise the fuel pressure level up to 4 according to the third valve closing signal pulse (3) for the first fuel pump 6*a*. Therefore, the length of the third valve closing signal pulse (3) for the first fuel pump 6*a* is set to a length needed to raise the fuel pressure level from 1 to 4. Incidentally, the relation between the fuel pressure level and the length of each valve closing signal pulse for the first fuel pump 6*a* has been determined in advance by experiments or the like, mapped properly and stored in the ECU 16.

Similarly, the length of the fourth valve closing signal pulse (4) for the first fuel pump 6*a* is determined in such a manner that the average fuel pressure for fuel injections according to four valve driving signal pulses for the fuel injection valves 3 becomes equal to the average fuel pressure from before the fuel injection according to the ninth valve driving signal pulse (9) for the fuel injection valves 3 until after the fuel injection according to the twelfth valve driving signal pulse (12) for the fuel injection valves 3, that is, the average fuel pressure level becomes the fuel level 2.

Here, note that there are four fuel injections after the fourth valve closing signal pulse (4) for the first fuel pump 6*a*. That is, the fuel pressure level is reduced by 4. On the other hand, the fuel pressure level is 0 immediately before the fourth valve closing signal pulse (4) for the first fuel pump 6*a*. Accordingly, in order to make the average fuel pressure level become 2, it is necessary to raise the fuel pressure level up to 4 according to the fourth valve closing signal pulse (4) for the first fuel pump 6*a*. Therefore, the length of the fourth valve closing signal pulse (4) for the first fuel pump 6*a*is set to a length needed to raise the fuel pressure level from 0 to 4.

Thereafter, the above processes are repeatedly carried out so that the average fuel pressure can be kept constant.

Figure 4:
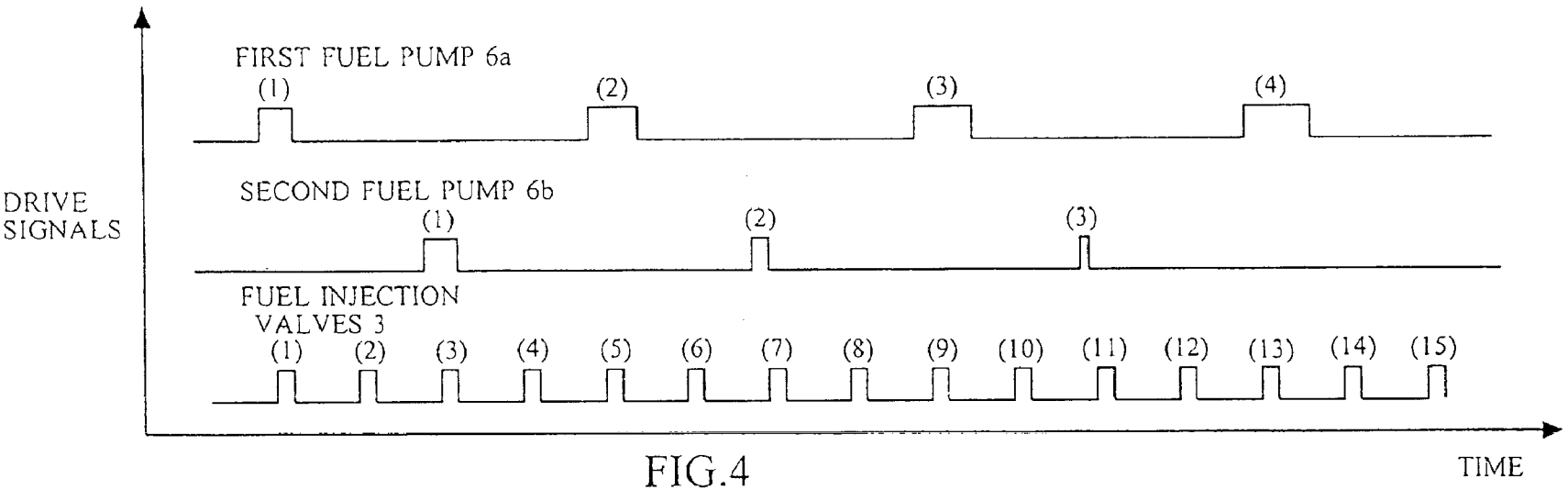
FIG. 4 is a timing chart showing the time course of a fuel pressure, drive signals for electromagnetic valves, and a drive signal for fuel injection valves when the amount of fuel discharged from one of the fuel pumps is gradually increased, and at the same time the amount of fuel discharged from the other fuel pump is gradually decreased to reduce the number of operating pumps, according to the first embodiment of the present invention.

Next, FIG. 4 is a timing chart that shows the time course of the fuel pressure level, the drive signals for the electromagnetic valves 64*a*, 64*b*, and the drive signal for the fuel injection valves 3 when the amount of fuel discharged from one of the fuel pumps is gradually increased, and at the time same time the amount of fuel discharged from the other of the fuel pumps is gradually decreased to stop the operation of that fuel pump, thereby reducing the number of operating pumps.

In FIG. 4, at first, the first fuel pump 6*a* and the second fuel pump 6*b* alternately discharge fuel from the corresponding cylinders 60*a*, 60*b*. First of all, the fuel pressure in the delivery pipe 4 is raised by the first valve closing signal pulse (1) for the first fuel pump 6*a*, during which fuel is injected into one of the cylinders 2 from a corresponding one of the fuel injection valves 3 by means of the first valve driving signal pulse (1) for the fuel injection valves 3, so the fuel pressure in the delivery pipe 4 is reduced. Further, fuel injection is thereafter performed according to the second valve driving signal pulse (2) for the fuel injection valves 3, whereby the fuel pressure is further reduced.

The length of the first valve closing signal pulse (1) for the first fuel pump 6*a* is determined in such a manner that even if the fuel pressure in the delivery pipe 4 is reduced as a result of the fuel injection according to the first valve driving signal pulse (1) for the fuel injection valves 3, there still remains such a fuel pressure under which fuel injection according to the second valve driving signal pulse (2) for the fuel injection valves 3 can be made.

In addition, the length of the first valve closing signal pulse (1) for the second fuel pump 6*b* is determined in such a manner that the average fuel pressure from before the fuel injection according to the third valve driving signal pulse (3) for the fuel injection valves 3 until after the fuel injection according to the fourth valve driving signal pulse (4) for the fuel injection valves 3 becomes equal to the average fuel pressure from before the fuel injection according to the first valve driving signal pulse (1) for the fuel injection valves 3 until after the fuel injection according to the second valve driving signal pulse (2) for the fuel injection valves 3.

Subsequently, the length of the second valve closing signal pulse (2) for the first fuel pump 6*a* and the length of the second valve closing signal pulse (2) for the second fuel pump 6*b* are determined in such a manner that the average fuel pressure from before the fuel injection according to the fifth valve driving signal pulse (5) for the fuel injection valves 3 until after the fuel injection according to the eighth valve driving signal pulse (8) for the fuel injection valves 3 becomes equal to the average fuel pressure from before the fuel injection according to the third valve driving signal pulse (3) for the fuel injection valves 3 until after the fuel injection according to the fourth valve driving signal pulse (4) for the fuel injection valves 3. At this time, the length of the second valve closing signal pulse (2) for the first fuel pump 6*a* is extended longer than the length of the first valve closing signal pulse (1) for the first fuel pump 6*a*, and at the same time, the length of the second valve closing signal pulse (2) for the second fuel pump 6*b* is shortened from or made shorter than the length of the first valve closing signal pulse (1) for the second fuel pump 6*b*. Incidentally, one of the amount of extension of the second valve closing signal pulse (2) for the first fuel pump 6*a* or the amount of shortening of the second valve closing signal pulse (2) for the second fuel pump 6*b* may be set to a fixed value, and the other thereof may be set such that the average fuel pressure can be kept at a constant or equal value.

Similarly, the length of the third valve closing signal pulse (3) for the first fuel pump 6*a* and the length of the third valve closing signal pulse (3) for the second fuel pump 6*b* are determined in such a manner that the average fuel pressure from before the fuel injection according to the ninth valve driving signal pulse (9) for the fuel injection valves 3 until after the fuel injection according to the twelfth valve driving signal pulse (12) for the fuel injection valves 3 becomes equal to the average fuel pressure from before the fuel injection according to the fifth valve driving signal pulse (5) for the fuel injection valves 3 until after the fuel injection according to the eighth valve driving signal pulse (8) for the fuel injection valves 3. At this time, the length of the third valve closing signal pulse (3) for the first fuel pump 6*a* is extended longer than the length of the second valve closing signal pulse (2) for the first fuel pump 6*a*, and at the same time, the length of the third valve closing signal pulse (3) for the second fuel pump 6*b* is shortened from or made shorter than the length of the second valve closing signal pulse (2) for the second fuel pump 6*b*.

In addition, the length of the fourth valve closing signal pulse (4) for the first fuel pump 6*a* is determined in such a manner that the average fuel pressure for fuel injections according to four valve driving signal pulses for the fuel injection valves 3 becomes equal to the average fuel pressure from before the fuel injection according to the ninth valve driving signal pulse (9) for the fuel injection valves 3 until after the fuel injection according to the twelfth valve driving signal pulse (12) for the fuel injection valves 3.

Thus, it is possible to decrease the number of operating pumps while gradually changing the amounts of fuel discharged from the first and second fuel pumps 6*a*, 6*b*. In the same way, it is possible to increase the number of operating pumps while gradually changing the amounts of fuel discharged from the first and second fuel pumps 6*a*, 6*b*.

Incidentally, in this embodiment, the amounts of fuel to be discharged from the fuel pumps 6*a*, 6*b* (i.e., the length of each valve closing signal pulse for each the electromagnetic valves 64*a*, 64*b*) can be controlled in a feedback manner. That is, the amounts of fuel discharged from the fuel pumps are controlled in a feedback manner so as to adjust the output signal of the fuel pressure sensor 4*a* to a target value. The target value has been determined in advance by experiments or the like, mapped properly and stored in the ECU 16.

However, the fuel pumps 60*a*, 60*b* have individual differences, and hence when a feedback control value for one of the fuel pumps is applied to the other fuel pump, the amount of fuel discharged therefrom might not become a desired amount of discharged fuel.

Accordingly, in case where the second fuel pump 6*b* is started to operate in a state where only the first fuel pump 6*a* is operating, the amount of fuel discharged from the second fuel pump 6*b* does not necessarily become a proper value if a control value, which is controlled in a feedback manner in accordance with the amount of fuel discharged from the first fuel pump 6*a*, is applied to the control of the second fuel pump 6*b* as it is. Therefore, in this embodiment, when the number of operating fuel pumps is increased, the control value being fed back is applied to only the first fuel pump 6*a* which has been operating from before the change of the number of operating fuel pumps.

As a result, variation in the amount of fuel discharged due to the individual differences of the fuel pumps can be suppressed.

As described in the foregoing, according to this embodiment, an amount of fuel to be discharged, which is required to make the average value of the fuel pressure constant, can be calculated before the fuel is actually discharged, thus making it possible to suppress the variation of the fuel pressure.

Here, reference will be made to the flow of signals around the ECU 16 in the above-mentioned embodiment of the present invention while referring to FIG. 12.

In FIG. 12, a dotted-line arrow (1) designates the flow of a detection signal from the fuel pressure sensor 4*a* to the ECU 16. A dotted-line arrow (2) designates the flow of signals from the fuel pump unit 6 comprising the first fuel pump 6*a* and the second fuel pump 6*b* to the ECU 16, whereby the signals representing the number of operating fuel pumps, the amount of fuel discharged from each fuel pump, etc., are supplied to the ECU 16. Also, a dotted-line arrow (3) designates the flow of signals from the ECU 16 to each of the fuel pumps 6*a*, 6*b*, based on which the operating state, the amount of discharged fuel, etc., of each fuel pump are controlled by the ECU 16. A dotted-line arrow (4) designates the flow of signals from the fuel injection valves 3 to the ECU 16, whereby the signals representing the driving states such as the number of injections, etc., of the fuel injection valves 3 are supplied to the ECU 16. Finally, a dotted-line arrow (5) designates the flow of signals from the ECU 16 to the fuel injection valves 3, based on which the driving states of the fuel injection valves 3 are controlled by the ECU 16. Here, note that in FIG. 12, a solid line arrow designates the flow of fuel from the fuel pump unit 6 to the fuel injection valves 3.

In the above-mentioned embodiment, the first fuel pump 6*a* and the second fuel pump 6*b* are used as fuel discharge devices, and the fuel injection valves 3 are used as a fuel pressure reducing device. Here, when the operating states of the first fuel pump 6*a* and the second fuel pump 6*b* are changed, i.e., when either one of the fuel pumps 6*a*, 6*b* is stopped or when either of the fuel pumps 6*a*, 6*b*, which is out of operation, is started to operate, the average value of the fuel pressure is adjusted by the ECU 16 which executes a control program stored therein. Here, the control program stored in the ECU 16 constitutes a fuel pressure adjusting section 201 for adjusting the average value of the fuel pressure. The fuel pressure adjusting section 201 serves to change the number of operations and the amount of discharged fuel of these fuel pumps 6*a*, 6*b* in such a manner that the average value of the fuel pressure after the fuel pressure has once been raised until the fuel pressure is again raised becomes equal or constant before and after the number of operating fuel pumps 6*a*, 6 is changed.

In addition, in order to control the average value of the fuel pressure, the ECU 16 executes a control program stored therein so that the amounts of fuel discharged from the fuel pump unit 6 is properly controlled in a feedback manner based on the value of the fuel pressure in the delivery pipe 4 detected by the fuel pressure sensor 4*a*. Here, the control program stored in the ECU 16 constitutes a fuel discharge amount feedback control section 202 for controlling the amount of fuel discharged from the fuel pump unit 6 in a feedback manner. When the number of operations of the first and second fuel pumps 6*a*, 6*b* is increased, the fuel discharge amount feedback control section 202 applies an amount of fuel to be discharged, which is determined based on a feedback control value before the number of operating fuel pumps is increased, only to an amount of fuel to be discharged from the fuel pump that has been operating from before the increase of the number of operating fuel pumps.

<Second Embodiment>

In this embodiment, when an internal combustion engine is started, one of high pressure fuel pumps in the form of fuel pumps 6*a*, 6*b* is operated and the other high pressure fuel pump is stopped, so that a shortage in the fuel pressure at the engine starting is obviated. Here, note that in this embodiment, the basic structure of the internal combustion engine, to which the present invention is applied, and the rest of hardware are common with those of the above-mentioned first embodiment, and hence an explanation thereof is omitted.

In the internal combustion engine, the amount of fuel to be injected into each engine cylinder is increased for engine warm-up operation at cold starting, and hence a required amount of fuel may sometimes be increased more than a maximum fuel discharge amount of the high pressure fuel pumps 6*a*, 6*b*, thus resulting in reduction in the fuel pressure in the delivery pipe 4. In a known fuel supply system for an internal combustion engine, to cope with such a situation, an electromagnetic valve for controlling the high pressure fuel pump is held in its open state so as to enable fuel injection, so that fuel is injected from each injection valve by the pressure of the fuel (feed pressure) discharged from a low pressure fuel pump, thereby performing engine starting.

Figure 5:
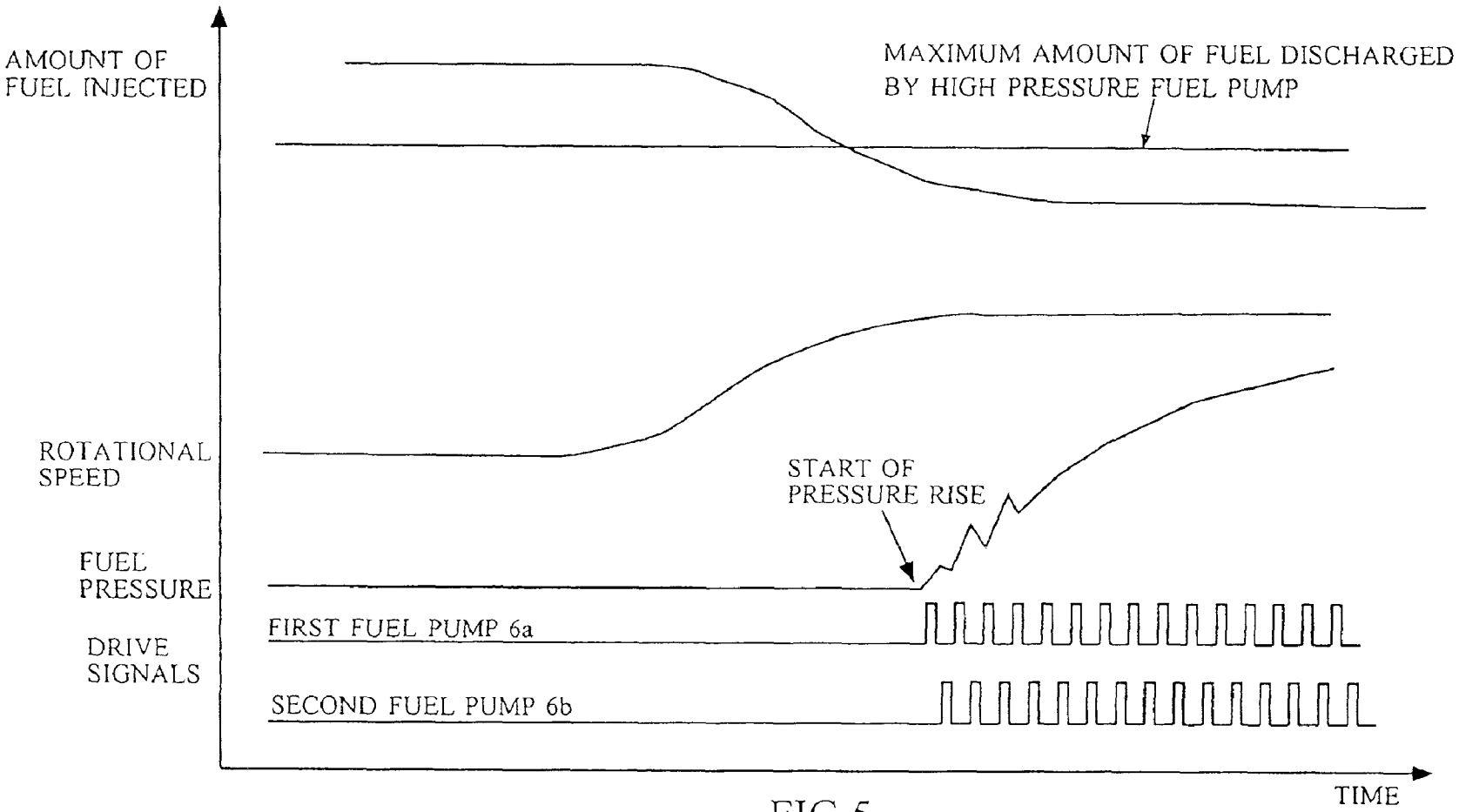
FIG. 5 is a view showing the operating states of fuel pumps at the time of engine starting in a known fuel supply system for an internal combustion engine.

FIG. 5 is a view that shows the operating states of the fuel pumps at the engine starting in accordance with such a fuel supply system for an internal combustion engine. Here, it is assumed that this fuel supply system has substantially the same construction as that illustrated in FIG. 1, from a hardware point of view, and hence the following explanation will be made with reference to FIG. 1. The amount of fuel to be injected from each injection valve 3, being set to a maximum at the time of engine starting, exceeds the maximum amount of fuel to be discharged from each of the high pressure fuel pumps in the form of the first and second fuel pumps 6*a*, 6*b*, both of which are stopped at the engine starting. As the internal combustion engine is started, the rotational speed of the engine is gradually increasing to place the engine into an idle state, during which the amount of fuel to be injected from each fuel injection valve 3 falls below the maximum amount of fuel discharged by the high pressure fuel pumps 6*a*, 6*b*, and thereafter the first fuel pump 6*a* and the second fuel pump 6*b* are driven to operate.

However, if the high pressure fuel pumps 6*a*, 6*b* are started to operate after the starting of the engine, i.e., after the rotational speed of the engine has increased to a certain prescribed rotational speed, as shown in FIG. 5, it takes a relatively long time to pressurize the fuel to a sufficient pressure level, during which there is a fear that a shortage in the fuel pressure might be caused.

Accordingly, in this second embodiment, the engine 1 is started with the electromagnetic valve 64*a* for the first fuel pump 6*a* being held in its open state, while bringing the second fuel pump 6*b* into operation.

Figure 6:
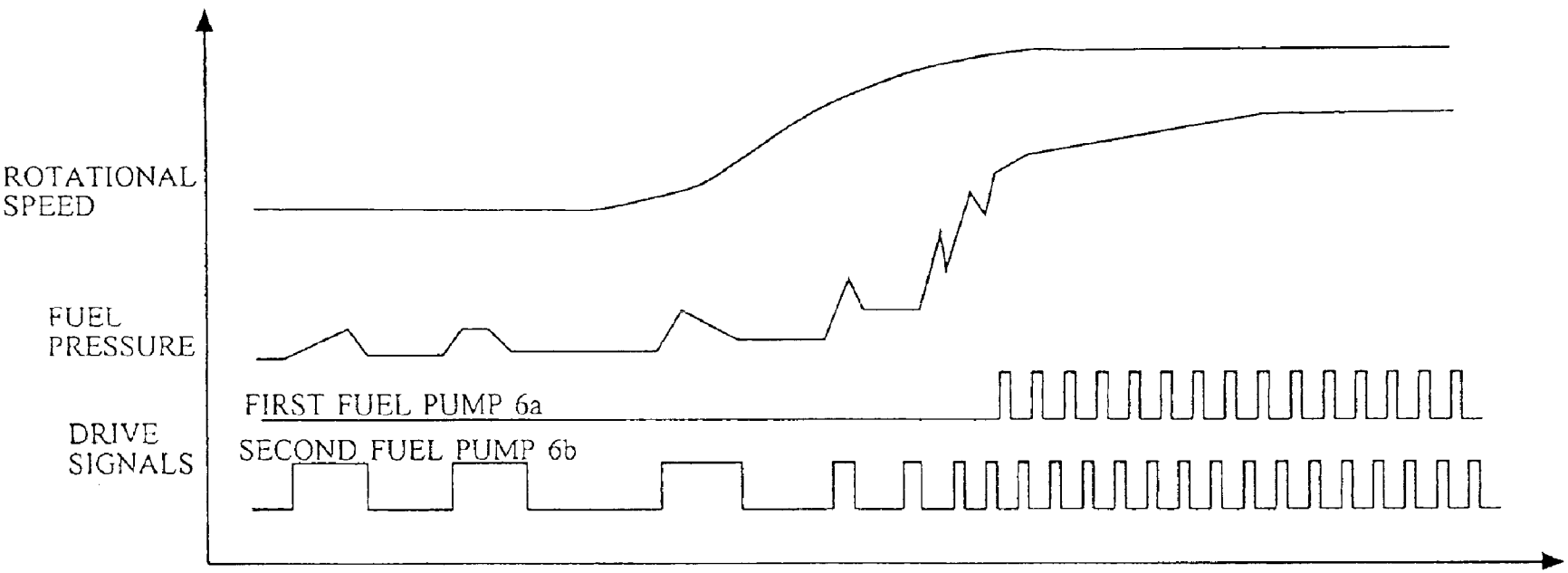
FIG. 6 is a view showing the operating states of fuel pumps at the time of engine starting in a fuel supply system for an internal combustion engine according to a second embodiment of the present invention.

FIG. 6 is a view that shows the operating states of the fuel pumps at the time of engine starting in the fuel supply system for an internal combustion engine according to the second embodiment of the present invention.

In this embodiment, the first fuel pump 6*a* is stopped but the second fuel pump 6*b* is operated at engine starting. The first fuel pump 6*a* in stopped state passes therethrough fuel discharged from the low pressure fuel pump 9, that is serves as a fuel passable pump. Here, the valve closure time or duration of the electromagnetic valve 64*b* is set longer at the time before the rotational speed of the engine increases above the prescribed value than at the time of engine idling operation. By so doing, it is possible not only to suppress the reduction in the fuel pressure due to a large amount of fuel injection when the rotational speed of the engine is increasing, but also to shorten the pressure rise time of the fuel pressure. As a result, a sufficient fuel pressure can be ensured, thereby making it easy to start the engine.

<Third Embodiment>

In this embodiment, the pulsation of the fuel pressure is reduced in a V-type internal combustion engine in which fuel discharged from a plurality of fuel pumps is supplied to a plurality of delivery pipes. Here, note that this embodiment is different from the above-mentioned first embodiment in the following features. That is, the internal combustion engine to which a fuel supply system according to this embodiment is applied is of the V type; the fuel pumps are installed, independently of each other, on the V banks of the engine, one for each bank; and the delivery pipes are installed on the V banks, respectively. However, the fundamental structure of the rest of hardware of this embodiment is common with that of the first embodiment, and hence an explanation thereof is omitted.

Figure 7:
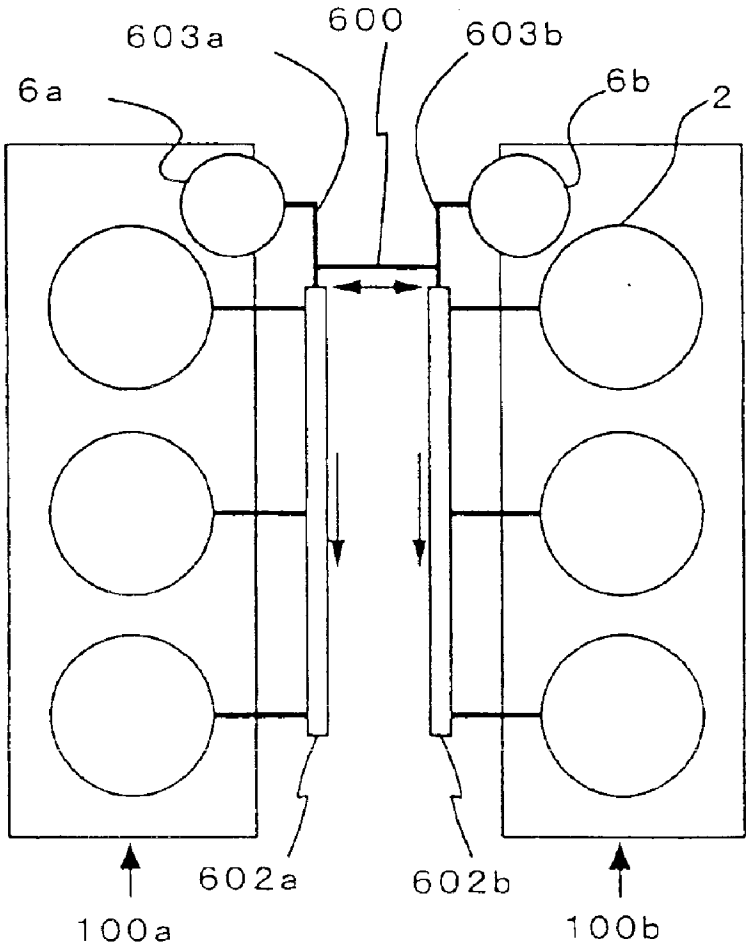
FIG. 7 is a view showing the schematic construction of an internal combustion engine with a fuel supply system for comparison purpose.

FIG. 7 is a view that shows the schematic construction of an internal combustion engine with a fuel supply system for comparison purpose.

The internal combustion engine as illustrated in FIG. 7 is a four-cycle gasoline engine having six cylinders 2.

The internal combustion engine is constructed to have a first bank 100*a* and a second bank 100*b*. In addition, a first fuel pump 6*a* is installed on the first bank 100*a*, and a second fuel pump 6*b* is installed on the second bank 100*b*. The first fuel pump 6*a* has a fuel outlet (discharge port) thereof connected with a delivery pipe 602*a* through a fuel feed pipe 603*a*, whereas the second fuel pump 6*b* has a fuel outlet (discharge port) thereof connected with the a delivery pipe 602*b* through a fuel feed pipe 603*b*. In this manner, the delivery pipe 602*a* serves to supply fuel to the respective cylinders of the first bank 100*a*, and the delivery pipe 602*b* serves to supply fuel to the respective cylinders of the second bank 100*b*. Further, the fuel feed pipe 603*a* and the fuel feed pipe 603*b* are connected with each other through a communication pipe 600.

In the fuel supply system for an internal combustion engine as constructed above, the fuel discharged from the first fuel pump 6*a* is supplied to the delivery pipe 602*a* through the fuel feed pipe 603*a*, and at the same time to the delivery pipe 602*b* through the communication pipe 600. Similarly, the fuel discharged from the second fuel pump 6*b* is supplied to the delivery pipe 602*b* through the fuel feed pipe 603*b*, and at the same time to the delivery pipe 602*a* through the communication pipe 600. Here, note that the discharge timings of the first and second fuel pumps 6*a*, 6*b* are determined such that the pulsations of the fuel pressure due to these fuel pumps are counteracted with each other. For example, when the first fuel pump 6*a* is operated to discharge fuel, the second fuel pump 6*b* is operated to draw or suck fuel from the fuel tank 10.

Thus, by placing the fuel feed pipes 603*a*, 603*b* in communication with each other, the pulsation of the fuel pressure due to the first fuel pump 6*a* can be counterbalanced by the pulsation of the fuel pressure due to the second fuel pump 6*b*, so that the variations of the fuel pressure in the delivery pipes 602*a*, 602*b* can be suppressed.

Figure 8:
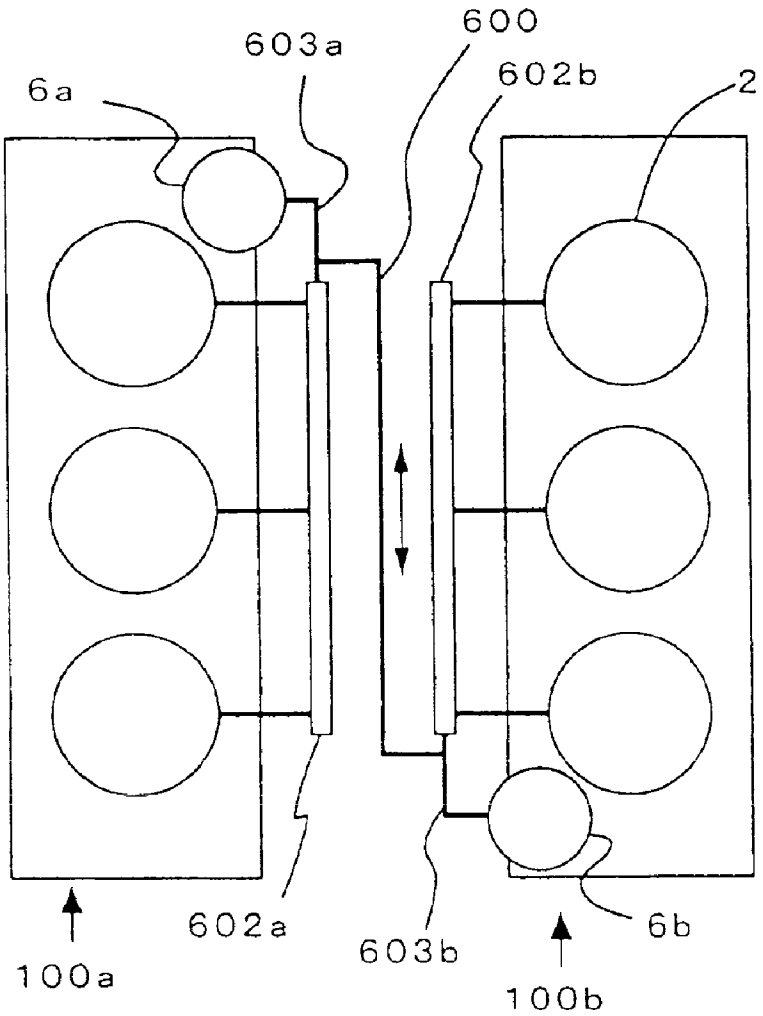
FIG. 8 is a view similar to FIG. 7, but showing another fuel piping where the installation positions of fuel pumps are different from those shown in FIG. 7.

Next, FIG. 8 is a view similar to FIG. 7, but showing another fuel piping where the installation positions of the fuel pumps are different from those in FIG. 7. That is, the first fuel pump 6*a* is arranged at one side of the engine, and the second fuel pump 6*b* is arranged at the other side of the engine.

Even in such a case, by placing the fuel feed pipes 603*a*, 603*b* in communication with each other, the pulsation of the fuel pressure due to the first fuel pump 6*a* can be counterbalanced by the pulsation of the fuel pressure due to the second fuel pump 6*b*, whereby the variations of the fuel pressure in the delivery pipes 602*a*, 602*b* can be effectively suppressed.

Moreover, in this embodiment, in order to further reduce the pulsation of the fuel pressure, the parts of fuel discharged from the plurality of fuel pumps are once merged or joined with one another before being supplied to the plurality of delivery pipes in the V-type internal combustion engine.

In the fuel supply systems as illustrated in FIGS. 7 and 8, the fuel discharged from the first fuel pump 6*a* passes through the communication pipe 600 into the delivery pipe 602*b*, whereas the fuel discharged from the second fuel pump 6*b* passes through the communication pipe 600 into the delivery pipe 602*a*. As a consequence, the direction of the fuel flow is alternately changed in the communication pipe 600, resulting in the increased pulsation of the fuel pressure. Accordingly, the pulsations of the fuel pressure in the delivery pipes 602*a*, 602*b* can not be suppressed in a satisfactory extent.

Thus, according to a third embodiment of the present invention, fuel piping is arranged such that fuel is delivered from one location of the communication pipe 600 to the respective delivery pipes so as to flow only in one direction, thereby making it possible to suppress the pulsation of the fuel pressure.

Figure 9:
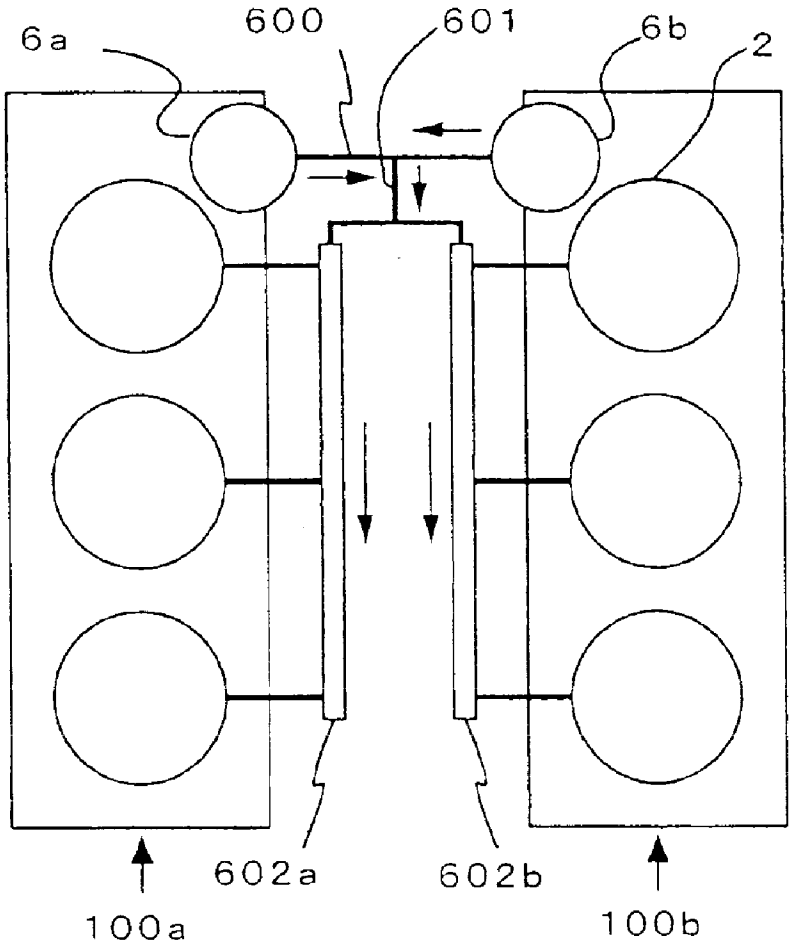
FIG. 9 is a view showing the schematic construction of an internal combustion engine with a fuel supply system applied thereto according to a third embodiment of the present invention.

FIG. 9 is a view that shows the schematic construction of an internal combustion engine with a fuel supply system applied thereto according to the third embodiment of the present invention.

The internal combustion engine as illustrated in FIG. 9 is a four-cycle V-type gasoline engine having six cylinders 2.

The internal combustion engine is constructed to have a first bank 100*a* and a second bank 100*b*. In addition, a first fuel pump 6*a* is installed on the first bank 100*a*, and a second fuel pump 6*b* is installed on the second bank 100*b*. The first fuel pump 6*a* and the second fuel pump 6*b* are placed in fluid communication with each other by connecting their fuel outlets (discharge ports) with each other through a communication pipe 600. A junction pipe 601 has one end thereof connected with a middle portion of the communication pipe 600, and the other end thereof branched to be connected with the delivery pipes 602*a*, 602*b*. Here, note that the communication pipe 600 and the junction pipe 601 together constitute a fuel supply pipe. The delivery pipe 602*a* serves to supply fuel to the respective cylinders of the first bank 100*a*, and the delivery pipe 602*b* serves to supply fuel to the respective cylinders of the second bank 100*b*.

In the fuel supply system for an internal combustion engine as constructed above, the fuel discharged from the first fuel pump 6*a* flows from the communication pipe 600 into the junction pipe 601, from which the fuel is then distributed to the delivery pipes 602*a*, 602*b*. Similarly, the fuel discharged from the second fuel pump 6*b* also flows from the communication pipe 600 into the junction pipe 601, from which the fuel is then distributed to the delivery pipes 602*a*, 602*b*. Thus, in the junction pipe 601, the fuel is permitted to flow only in a direction from the communication pipe 600 to the delivery pipes 602*a*, 602*b*, whereby the pulsation of the fuel pressure can be reduced.

Although in this embodiment, reference has been made to the V-type internal combustion engine, the fuel supply system as illustrated and described in this embodiment can be applied to any type of internal combustion engine provided with a plurality of delivery pipes.

As described above, according to this embodiment, the pulsation of the fuel pressure can be reduced by removing parts or regions in which fuel flows in opposite directions.

<Fourth Embodiment>

In a fourth embodiment of the present invention, the amount of fuel discharged is corrected from a difference between the amounts of fuel discharged from a plurality of fuel pumps, thereby suppressing the variation of the fuel pressure. Here, note that in this embodiment, the basic structure of the internal combustion engine, to which the present invention is applied, and the rest of hardware are common with those of the above-mentioned first embodiment, and hence an explanation thereof is omitted.

Here, there are individual differences in the fuel pumps, and hence even if the fuel discharge times or durations of these fuel pumps are the same, the amounts of fuel discharged from the fuel pumps may become different from each other.

Figure 10:
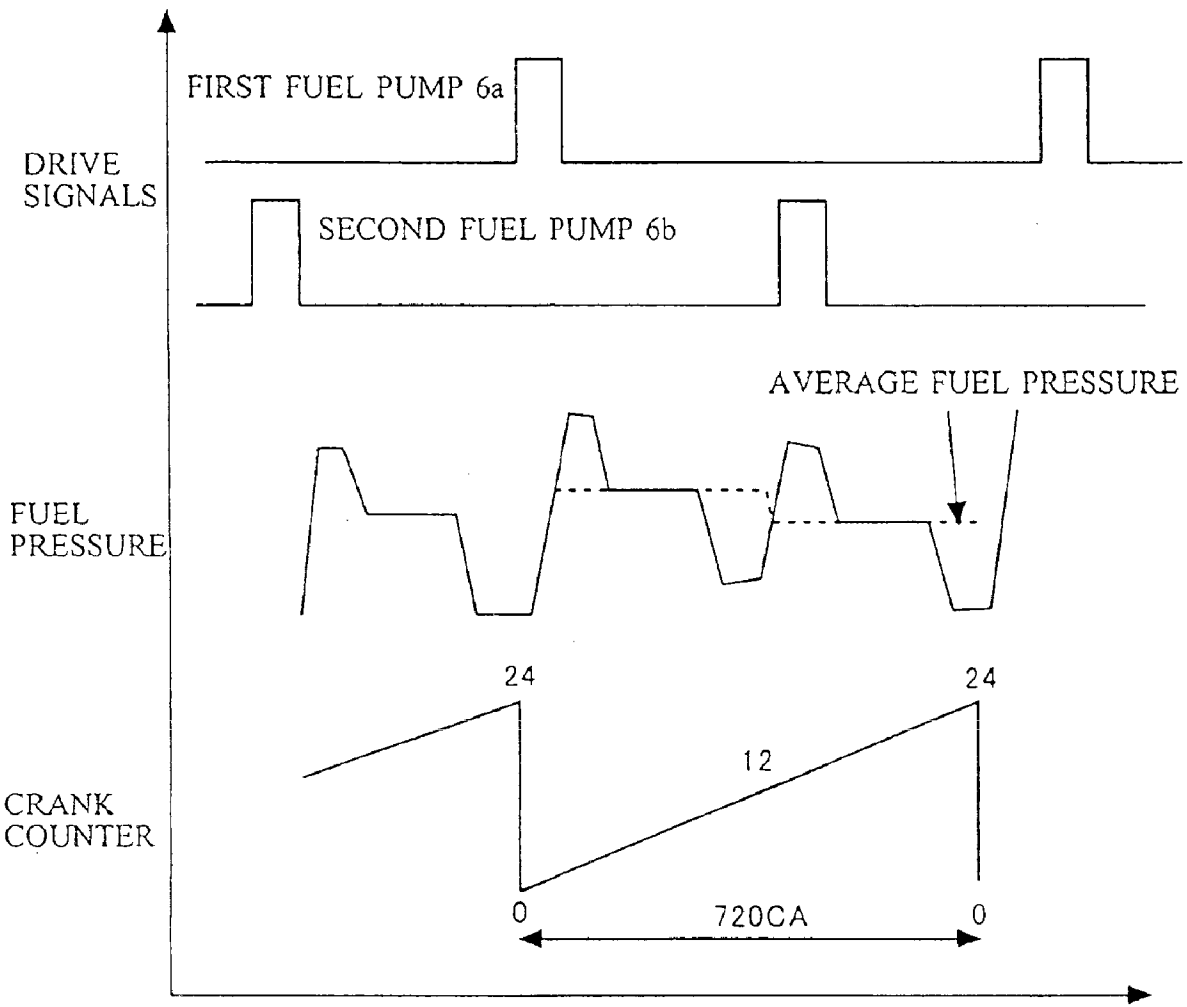
FIG. 10 is a timing chart showing variation in the fuel pressure when fuel is discharged from fuel pumps, respectively, according to the third embodiment of the present invention.

FIG. 10 is a timing chart that shows the variation of the fuel pressure when fuel is discharged from the fuel pumps, wherein a crank counter counts up by one every 30 degrees crank angle, and is cleared to zero every 720 degrees crank angle, that is, the same crank angle is indicated when the crank counter reads 0 or 24.

The fuel pressure is raised due to the discharge of fuel by the first fuel pump 6*a*, and thereafter the fuel pressure falls according to two fuel injections. Then, fuel is discharged by the second fuel pump 6*b* thereby to raise the fuel pressure again, and thereafter the fuel pressure falls according to two fuel injections. As a result, there is generated a difference between the average fuel pressure from immediately before the discharge of fuel by the first fuel pump 6*a* until immediately before the discharge of fuel by the second fuel pump 6*b* and the average fuel pressure from immediately before the discharge of fuel by the second fuel pump 6*b* until immediately before the next discharge of fuel by the first fuel pump 6*a*. Such a difference will result in greater variation in the fuel pressure.

Accordingly, in this fourth embodiment, the amount of fuel discharged from each of the fuel pumps 6*a*, 6*b* is adjusted through feedback control in such a manner that the average fuel pressure from immediately before fuel is discharged by one of the first fuel pump 6*a* and the second fuel pumps 6*b* until immediately before fuel is discharged by the other fuel pump becomes substantially equal or constant for the respective fuel pumps.

Figure 11:
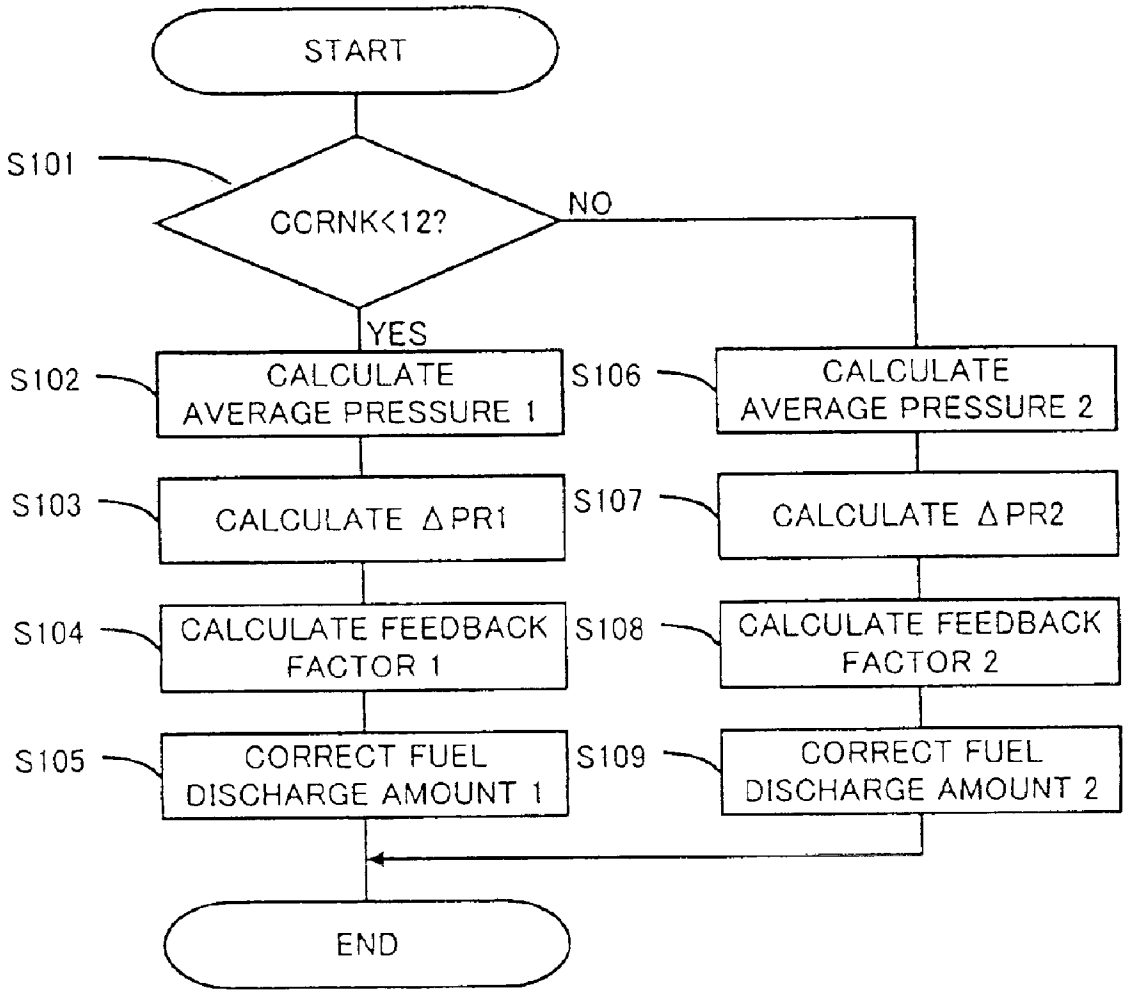
FIG. 11 is a flow chart showing a control flow that performs the processing of adjusting the amount of fuel to be discharged according to a fourth embodiment of the present invention.

FIG. 11 is a flow chart showing a control flow that performs the processing of adjusting the amounts of fuel to be discharged from the fuel pumps in accordance with the fourth embodiment of the present invention. The fuel discharge amount adjusting processing as illustrated in FIG. 11 is executed by the ECU 16.

In step S101, it is determined whether the reading of the crank counter is less than 12. That is, a determination is made based on the crank counter reading as to which one of the first fuel pump 6*a* and the second fuel pump 6*b* fuel has been discharged from. Here, when the crank counter reading is less than 12, it is meant that fuel has been discharged from the first fuel pump 6*a*, whereas when the crank counter reading is equal to or greater than 12, it is meant that fuel is discharged from the second fuel pump 6*b*.

When an affirmative determination is made in step S101, the control flow proceeds to step S102, whereas when a negative determination is made in step S101, the control flow proceeds to step S106.

In step S102, an average fuel pressure 1 during the time when the crank counter reading is equal to or greater than 0 and at the same time less than 12 is calculated. Here, note that the ECU 16 calculates the average fuel pressure 1 based on the fuel pressure which is detected by the fuel pressure sensor 4*a*.

In step S103, a difference ΔPR1 between a target fuel pressure and the average fuel pressure 1 is calculated. The target fuel pressure has been obtained in advance by experiments or the like and stored in the ECU 16.

In step S104, a feedback factor 1 in the feedback control of the amount of fuel discharged is calculated based on the difference ΔPR1. This feedback factor 1 is acquired from the relation between the difference ΔPR1 and the feedback factor 1, which has been obtained in advance by experiments or the like, mapped properly and stored in the ECU 16. The feedback factor 1 serves to increase the amount of fuel discharged from the first fuel pump 6*a* when the average fuel pressure 1 is lower than the target fuel pressure, and to decrease the amount of fuel discharged from the first fuel pump 6*a* when the average fuel pressure 1 is higher than the target fuel pressure. In actuality, the feedback factor 1 is to change the valve closure time or duration of the electromagnetic valve 64*a*. In addition, the greater the absolute value of the difference ΔPR1, the greater does the amount of change in the amount of fuel discharged from the first fuel pump 6*a* become, that is, the greater does the amount of change in the valve closure time or duration of the electromagnetic valve 64*a* become.

In step S105, the amount of fuel discharged from the first fuel pump 6*a* is corrected. Here, this amount of fuel discharged is changed by the feedback factor 1.

In step S106, an average fuel pressure 2 during the time when the crank counter reading is equal to or greater than 12 and at the same time less than 24 is calculated. In this regard, the ECU 16 calculates the average fuel pressure 2 based on the fuel pressure which is detected by the fuel pressure sensor 4*a*.

In step S107, a difference ΔPR2 between the target fuel pressure and the average fuel pressure 2 is calculated.

In step S108, a feedback factor 2 in the feedback control of the amount of fuel discharged is calculated based on the difference ΔPR2. This feedback factor 2 is acquired from the relation between the difference ΔPR2 and the feedback factor 2, which has been obtained in advance by experiments or the like, mapped properly and stored in the ECU 16. The feedback factor 2 serves to increase the amount of fuel discharged from the second fuel pump 6*b* when the average fuel pressure 2 is lower than the target fuel pressure, and to decrease the amount of fuel discharged from the second fuel pump 6*b* when the average fuel pressure 2 is higher than the target fuel pressure. In actuality, the feedback factor 2 is to change the valve closure time or duration of the electromagnetic valve 64*b*. In addition, the greater the absolute value of the difference ΔPR2, the greater does the amount of change in the amount of fuel discharged from the second fuel pump 6*b* become, that is, the greater does the amount of change in the valve closure time or duration of the electromagnetic valve 64*b* become.

In step S109, the amount of fuel discharged from the second fuel pump 6*b* is corrected. Here, this amount of fuel discharged is changed by the feedback factor 2.

In this manner, feedback control is carried out so as to bring the average fuel pressures 1 and 2 equal to the target fuel pressure, whereby variation in the fuel pressure can be effectively suppressed.

In this embodiment, the average fuel pressure according to one of the fuel pumps may be employed as the target fuel pressure, instead of using the fuel pressure stored in the ECU 16 as the target fuel pressure. By correcting only the amount of fuel discharged from one of the fuel pumps, variation in the fuel pressure can be suppressed while simplifying the feedback control.

Figure 13:
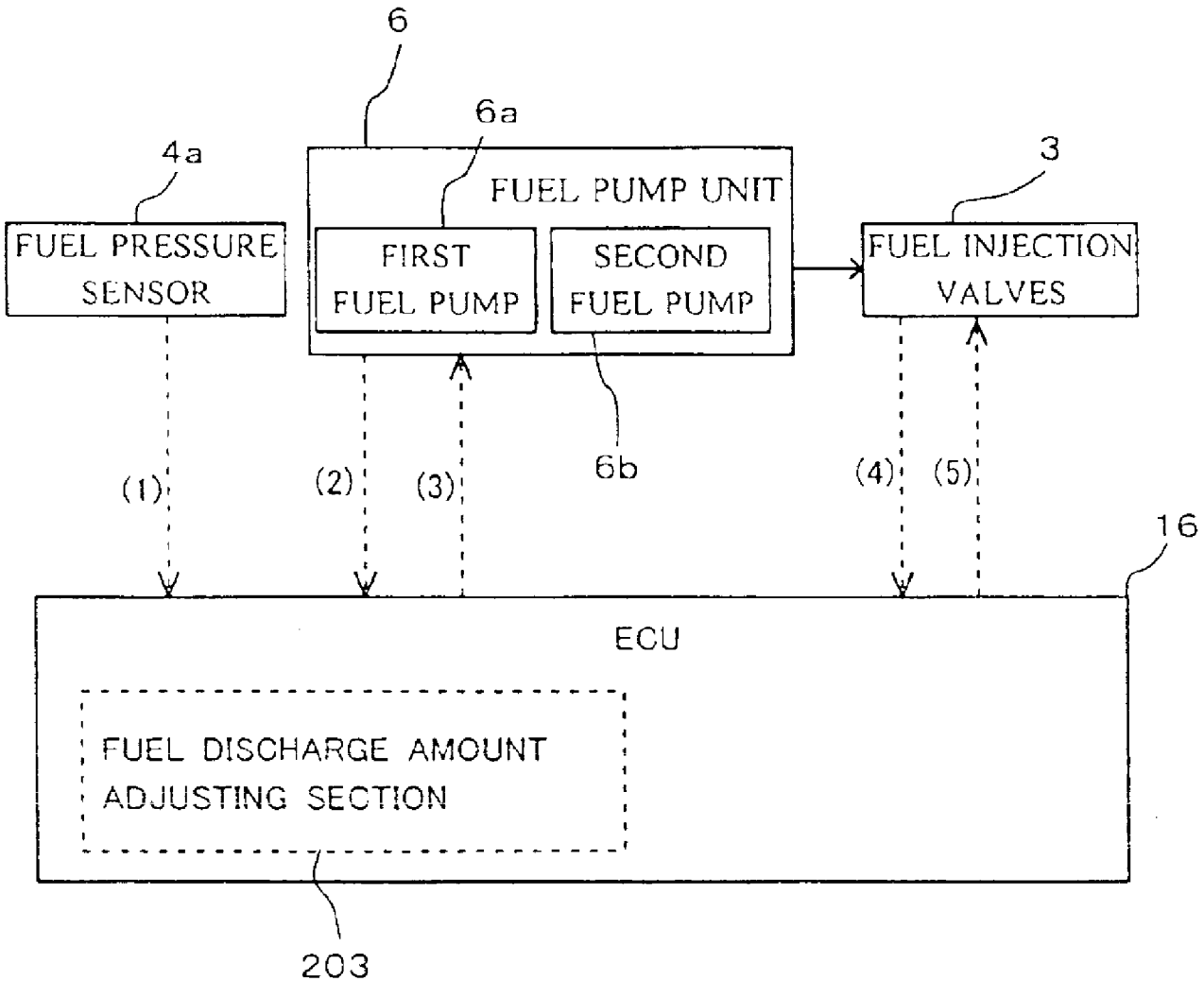
FIG. 13 is a view schematically showing the flow of control signals in the fuel supply system applied to the internal combustion engine according to the fourth embodiment of the present invention.

Here, reference will be made to the flow of signals around the ECU 16 in this fourth embodiment while referring to FIG. 13. FIG. 13 schematically shows the flows of control signals in the fuel supply system according to the fourth embodiment of the present invention.

In this embodiment, the first fuel pump 6*a* and the second fuel pump 6*b* are used as fuel discharge devices; the fuel injection valves 3 are used as a fuel pressure reducing device; and the fuel pressure sensor 4*a* is used as a fuel pressure detector. Here, the ECU 16 executes a control program stored therein to perform the control flow shown in FIG. 11 so as to make constant the average value of the fuel pressure detected by the fuel pressure sensor 4*a*, whereby the amount of fuel discharged from the first fuel pump 6*a* and/or the second fuel pump 6*b* can be properly adjusted. Here, the control program stored in the ECU 16 constitutes a fuel discharge amount adjusting section 203 for adjusting the amount of fuel discharged from the first fuel pump 6*a* and/or the second fuel pump 6*b*. This fuel discharge amount adjusting section 203 changes the amounts of fuel discharged from the plurality of fuel pumps 6*a*, 6*b* in such a manner that the average value of the fuel pressure detected by the fuel pressure sensor 4*a* during the time from after the fuel has once been pressurized by one of the fuel pumps 6*a*, 6*b* until the fuel is pressurized by the other fuel pump becomes substantially constant.

<Other Embodiments>

It is to be noted that the fuel supply systems for an internal combustion engine as described above can also be applied to a diesel engine of the compression ignition type in place of a gasoline engine. In addition, the present invention can also be applied to an internal combustion engine that is equipped with fuel injection valves for injecting fuel into an intake pipe or intake manifold in place of an internal combustion engine that is equipped with fuel injection valves for injecting fuel directly into the combustion chambers of engine cylinders.

As can be seen from the foregoing description, in a fuel supply system for an internal combustion engine according to the present invention, variation in the fuel pressure can be suppressed even if the fuel supply system is provided with a plurality of fuel pumps.

While the invention has been described in terms of preferred embodiments, those skilled in the art will recognize that the invention can be practiced with modifications within the spirit and scope of the appended claims.

What is claimed is:

1. A fuel supply system for an internal combustion engine, comprising:

a plurality of fuel discharge devices in which the pressure of fuel to be discharged therefrom can be adjusted due to an increase and a decrease in the amount of the fuel discharged when said fuel discharge devices are in operation, and the discharge of fuel therefrom can also be stopped;

a fuel pressure reducing device that reduces the fuel pressure raised by said fuel discharge devices; and a fuel pressure adjusting section that changes the number of operations of said fuel discharge devices and the amount of fuel discharged from each of said fuel discharge devices in such a manner that an average value of the fuel pressure from after the fuel pressure has once been raised until the fuel pressure is again raised becomes substantially constant before and after the number of operations of said fuel discharge devices is changed.

2. The fuel supply system for an internal combustion engine as set forth in claim 1, wherein said fuel pressure reducing device comprises a fuel injection valve for injecting the fuel; and said fuel pressure adjusting section determines the amount of fuel discharged from said fuel discharge devices based on the fuel pressure before the discharge of fuel by said fuel discharge devices, the number of operations of said fuel discharge devices, and the number of fuel injections by said fuel injection valve during the time from after the fuel pressure has once been raised until the fuel pressure is again raised.

3. The fuel supply system for an internal combustion engine as set forth in claim 1, wherein when the number of operations of said fuel discharge devices is increased, said fuel pressure adjusting section starts the discharge of fuel from at least one of stopped fuel discharge devices after the amount of fuel discharged from each of operating fuel discharge devices is decreased.

4. The fuel supply system for an internal combustion engine as set forth in claim 1, wherein when the number of operations of said fuel discharge devices is decreased, said fuel pressure adjusting section stops the discharge of fuel from at least one of operating fuel discharge devices after the amount of fuel discharged from each of the other operating fuel discharge devices is increased.

5. The fuel supply system for an internal combustion engine as set forth in claim 1, wherein when the number of operations of said fuel discharge devices is increased or decreased, said fuel pressure adjusting section gradually changes the amount of fuel discharged from each of said fuel discharge devices.

6. The fuel supply system for an internal combustion engine as set forth in claim 1, further comprising a fuel discharge amount feedback control section that controls the amount of fuel discharged from each of said fuel discharge devices, wherein when the number of operations of said fuel discharge devices is increased, said fuel discharge amount feedback control section applies an amount of fuel to be discharged, which is determined based on a feedback control value before the increase in the number of operations of said fuel discharge devices, only to those of said fuel discharge devices which have been operating before the increase in the number of operations of said fuel discharge devices.

7. A fuel supply system for an internal combustion engine, comprising:

a plurality of fuel discharge devices in which the pressure of fuel to be discharged therefrom can be adjusted due to an increase and a decrease in the amount of the fuel discharged when said fuel discharge devices are in operation, and the discharge of fuel therefrom can also be stopped;

a fuel pressure reducing device that reduces the fuel pressure raised by said fuel discharge devices;

a fuel pressure detector that detects the pressure of fuel discharged from said fuel discharge devices; and a fuel discharge amount adjusting section that changes the amount of fuel discharged from each of said plurality of fuel discharge devices in such a manner that an average value of the fuel pressure detected by said fuel pressure detector during the time from after the fuel has once been pressurized by one of said fuel discharge devices until the fuel is again pressurized by another one of said fuel discharge devices becomes substantially constant.

8. The fuel supply system for an internal combustion engine as set forth in claim 7, wherein said fuel discharge amount adjusting section controls the amount of fuel discharged from each of said fuel discharge devices in a feedback manner such that the fuel pressure detected by said fuel pressure detector becomes a target fuel pressure.

9. A fuel supply system for an internal combustion engine, comprising:

a plurality of fuel discharge devices that discharge fuel;

a plurality of fuel injection devices that inject the fuel pressurized by said fuel discharge devices;

a fuel supply pipe having one end thereof branched to be connected with said plurality of fuel discharge devices, and the other end thereof provided with one outlet; and fuel delivery pipes branching from the one outlet of said fuel supply pipe so as to be connected with said plurality of fuel injection devices.

10. The fuel supply system for an internal combustion engine as set forth in claim 9, wherein said plurality of fuel discharge devices successively discharge fuel into said fuel supply pipe at a constant interval between the discharge of fuel by one of said fuel discharge devices and the discharge of fuel by another one of said fuel discharge devices.

11. The fuel supply system for an internal combustion engine as set forth in claim 9, wherein said plurality of fuel discharge devices comprises a first fuel discharge device and a second fuel discharge device; and the discharge of fuel into said fuel supply pipe by said first fuel discharge device and the discharge of fuel into said fuel supply pipe by said second fuel discharge device are alternately carried out at a constant interval.

12. The fuel supply system for an internal combustion engine, comprising:

a low pressure fuel pump that discharges fuel at a low pressure; and a plurality of high pressure fuel pumps that further raise the pressure of fuel discharged from said low pressure fuel pump; wherein at least one of said high pressure fuel pumps serves, when stopped, as a fuel passable pump that can pass therethrough the fuel discharged from said low pressure fuel pump, and when said internal combustion engine is started, at least one of said high pressure fuel pumps is stopped in its operation to serve as a fuel passable pump, and at the same time at least another one of said high pressure fuel pumps is driven to operate.

13. The fuel supply system for an internal combustion engine as set forth in claim 12, wherein when the rotational speed of said internal combustion engine increases up to a prescribed speed at the time of engine starting, said at least one high pressure fuel pump serving as a fuel passable pump starts to raise the pressure of fuel discharged from said low pressure fuel pump.

14. The fuel supply system for an internal combustion engine as set forth in claim 13, wherein in at least one of said high pressure fuel pumps that does not serve as a fuel passable pump but raise the pressure of fuel discharged from said low pressure fuel pump during the starting of said internal combustion engine, the amount of fuel discharged from said at least one high pressure fuel pump until the rotational speed of said internal combustion engine increases to said prescribed speed is more than the amount of fuel discharged from said at least one high pressure fuel pump after the rotational speed of said internal combustion engine has increased to said prescribed speed.

15. The fuel supply system for an internal combustion engine as set forth in claim 2, wherein when the number of operations of said fuel discharge devices is increased, said fuel pressure adjusting section starts the discharge of fuel from at least one of stopped fuel discharge devices after the amount of fuel discharged from each of operating fuel discharge devices is decreased.

16. The fuel supply system for an internal combustion engine as set forth in claim 2, wherein when the number of operations of said fuel discharge devices is decreased, said fuel pressure adjusting section stops the discharge of fuel from at least one of operating fuel discharge devices after the amount of fuel discharged from each of the other operating fuel discharge devices is increased.

17. The fuel supply system for an internal combustion engine as set forth in claim 2, wherein when the number of operations of said fuel discharge devices is increased or decreased, said fuel pressure adjusting section gradually changes the amount of fuel discharged from each of said fuel discharge devices.

18. The fuel supply system for an internal combustion engine as set forth in claim 2, further comprising a fuel discharge amount feedback control section that controls the amount of fuel discharged from each of said fuel discharge devices, wherein when the number of operations of said fuel discharge devices is increased, said fuel discharge amount feedback control section applies an amount of fuel to be discharged, which is determined based on a feedback control value before the increase in the number of operations of said fuel discharge devices, only to those of said fuel discharge devices which have been operating before the increase in the number of operations of said fuel discharge devices.

* * * * *